US011156431B2

(12) United States Patent
Hedeen, Jr. et al.

(10) Patent No.: US 11,156,431 B2
(45) **Date of Patent: *Oct. 26, 2021**

(54) TOY DART GUNS HAVING DOUBLE ACTION TRIGGER ASSEMBLIES AND TOY DARTS FOR USE WITH THE SAME

(71) Applicant: Hedeen International, LLC, Sturgeon Bay, WI (US)

(72) Inventors: Clemens V. Hedeen, Jr., Sturgeon Bay, WI (US); Kay Lee Hedeen, Sturgeon Bay, WI (US); Matthew P. Davis, Green Bay, WI (US)

(73) Assignee: HEDEEN INTERNATIONAL, LLC, Sturgeon Bay, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/991,377

(22) Filed: Aug. 12, 2020

(65) Prior Publication Data

US 2020/0370862 A1 Nov. 26, 2020

Related U.S. Application Data

(63) Continuation of application No. 16/831,080, filed on Mar. 26, 2020, now Pat. No. 10,782,089.

(60) Provisional application No. 62/823,952, filed on Mar. 26, 2019.

(51) Int. Cl.
*F41B 11/642* (2013.01)
*F41B 11/646* (2013.01)

(52) U.S. Cl.
CPC ..... *F41B 11/646* (2013.01)

(58) Field of Classification Search
CPC ..... F41B 11/642; F41B 11/647; F41B 11/648; F41B 7/003; F41B 7/08
See application file for complete search history.

(56) References Cited

U.S. PATENT DOCUMENTS 2,561,849 A 7/1951 Everett
2,730,094 A 1/1956 Hicks
4,195,615 A 4/1980 Belokin
(Continued)

OTHER PUBLICATIONS

Nerf N-Strike Mega RotoFury Blaster; https://www.amazon.com/Nerf-N-Strike-Mega-RotoFury-Blaster/dp/B00TDP7RZY; Jan. 22, 2018; 11 pages.

*Primary Examiner* — J. Woodrow Eldred
(74) *Attorney, Agent, or Firm* — Dinsmore & Shohl LLP

(57) ABSTRACT

A toy dart gun is provided including a gun shell, a trigger assembly, and a compression assembly. The trigger assembly includes a swing arm coupled to the gun shell and movable between a safe position and a fire position, and a swing arm pusher extending from the gun shell and having an inclined surface. The compression assembly includes a compression chamber positioned within the gun shell and having a barrel opening and an opposite holder opening, and a plunger slidably insertable through the holder opening and movable between a retracted position and an extended position. As the swing arm moves toward the fire position, the swing arm engages the plunger and pulls the plunger toward the extended position. When the swing arm is in the fire position, the swing arm pusher deflects the swing arm from engagement with the plunger and the plunger is biased toward the retracted position.

20 Claims, 17 Drawing Sheets

(56) References Cited

U.S. PATENT DOCUMENTS

| | | | | |
|---|---|---|---|---|
| 4,841,655 | A * | 6/1989 | Ferri | F41B 11/54 124/66 |
| 5,622,160 | A | 4/1997 | Casas Salva | |
| 5,645,038 | A * | 7/1997 | Luk | F41B 11/642 124/67 |
| 7,257,918 | B2 | 8/2007 | Moore | |
| 9,080,830 | B2 | 7/2015 | Hendricks et al. | |
| 2006/0191523 | A1 | 8/2006 | Paletz | |
| 2012/0178338 | A1 | 7/2012 | Mowbray | |
| 2012/0216786 | A1* | 8/2012 | Hadley | F41B 11/646 124/66 |
| 2015/0354918 | A1 | 12/2015 | Gore | |
| 2017/0234639 | A1 | 8/2017 | Kuracina | |
| 2018/0058801 | A1* | 3/2018 | Gore | F16F 9/02 |

* cited by examiner

TOY DART GUNS HAVING DOUBLE ACTION TRIGGER ASSEMBLIES AND TOY DARTS FOR USE WITH THE SAME

CROSS-REFERENCE TO RELATED APPLICATION

This application is a continuation application of U.S. Non-Provisional patent application Ser. No. 16/831,080, filed Mar. 26, 2020, for "Toy Dart Guns Having Double Action Trigger Assemblies And Toy Darts For Use With The Same," which claims the benefit of U.S. Provisional Patent Application No. 62/823,952, filed Mar. 26, 2019, for "Toy Dart Guns Having Double Action Trigger Assemblies And Toy Darts For Use With The Same," both of which are hereby incorporated by reference in their entirety including the drawings.

TECHNICAL FIELD

The present disclosure is directed to toy dart guns and toy darts, more particularly, toy dart guns having double action trigger mechanisms and tubular toy darts for use with the same.

BACKGROUND

Typically toy dart guns are provided with either a manual cocking mechanism or an automatic cocking mechanism. Previously known manual cocking mechanisms are provided with a cocking actuator that is separate from a trigger of a trigger mechanism. The cocking actuator, such as a slide, lever, or tab, is actuated to move a firing assembly from a safe position to a fire position. However, as the manual cocking assembly is separate from the trigger mechanism, a user is required to manually actuate the cocking assembly and then a separate action to actuate the trigger of the trigger mechanism to launch the dart. As such, a user is required to perform two separate actions in order to launch the dart.

Previously known automatic cocking mechanisms are capable of launching a dart with only a single action of actuating the trigger of the trigger mechanisms. However, the previously known automatic cocking mechanisms require a motor and batteries to power the motor, and/or a self-contained supply of compressed gas. As such, the previously known toy dart guns having automatic cocking mechanisms are complex and require additional components which increase both the weight and cost of the toy dart gun. Further, the previously known automatic cocking mechanisms require replacement batteries and/or self-contained supplies of compressed gas.

Accordingly, a need exists for alternative toy dart guns that can actuate a cocking mechanism and actuate a trigger mechanism with a single action by the user that does not increase the complexity, weight, and/or cost of the toy dart gun in requiring cocking mechanisms that require battery powered motors or self-contained supply of compressed gas.

SUMMARY

In one embodiment, a toy dart gun includes a gun shell, a trigger assembly, and a compression assembly. The trigger assembly includes a swing arm coupled to the gun shell and movable between a safe position and a fire position, and a swing arm pusher extending from the gun shell and having an inclined surface. The compression assembly includes a compression chamber positioned within the gun shell and having a barrel opening and an opposite holder opening, and a plunger slidably insertable through the holder opening of the compression chamber and movable between a retracted position and an extended position. As the swing arm moves toward the fire position, the swing arm engages the plunger and pulls the plunger toward the extended position. When the swing arm is in the fire position, the swing arm pusher deflects the swing arm from engagement with the plunger and the plunger is biased toward the retracted position.

In another embodiment, a toy dart gun includes a gun shell, a trigger assembly, and a compression assembly. The trigger assembly includes a trigger pivotally attached to the gun shell and coupled to the swing arm, the trigger movable between an undepressed position and a depressed position, the trigger causing the swing arm to move toward the fire position as the trigger pivots toward the depressed position, a swing arm coupled to the trigger and movable between a safe position and a fire position, and a swing arm pusher extending from the gun shell and having an inclined surface. The compression assembly includes a compression chamber positioned within the gun shell and having a barrel opening and an opposite holder opening, and a plunger slidably insertable through the holder opening of the compression chamber and movable between a retracted position and an extended position. As the swing arm moves toward the fire position, the swing arm engages the plunger and pulls the plunger toward the extended position. When the swing arm is in the fire position, the swing arm pusher deflects the swing arm from engagement with the plunger and the plunger is biased toward the retracted position.

These and additional features provided by the embodiments described herein will be more fully understood in view of the following detailed description, in conjunction with the drawings.

DETAILED DESCRIPTION

Figure 1:
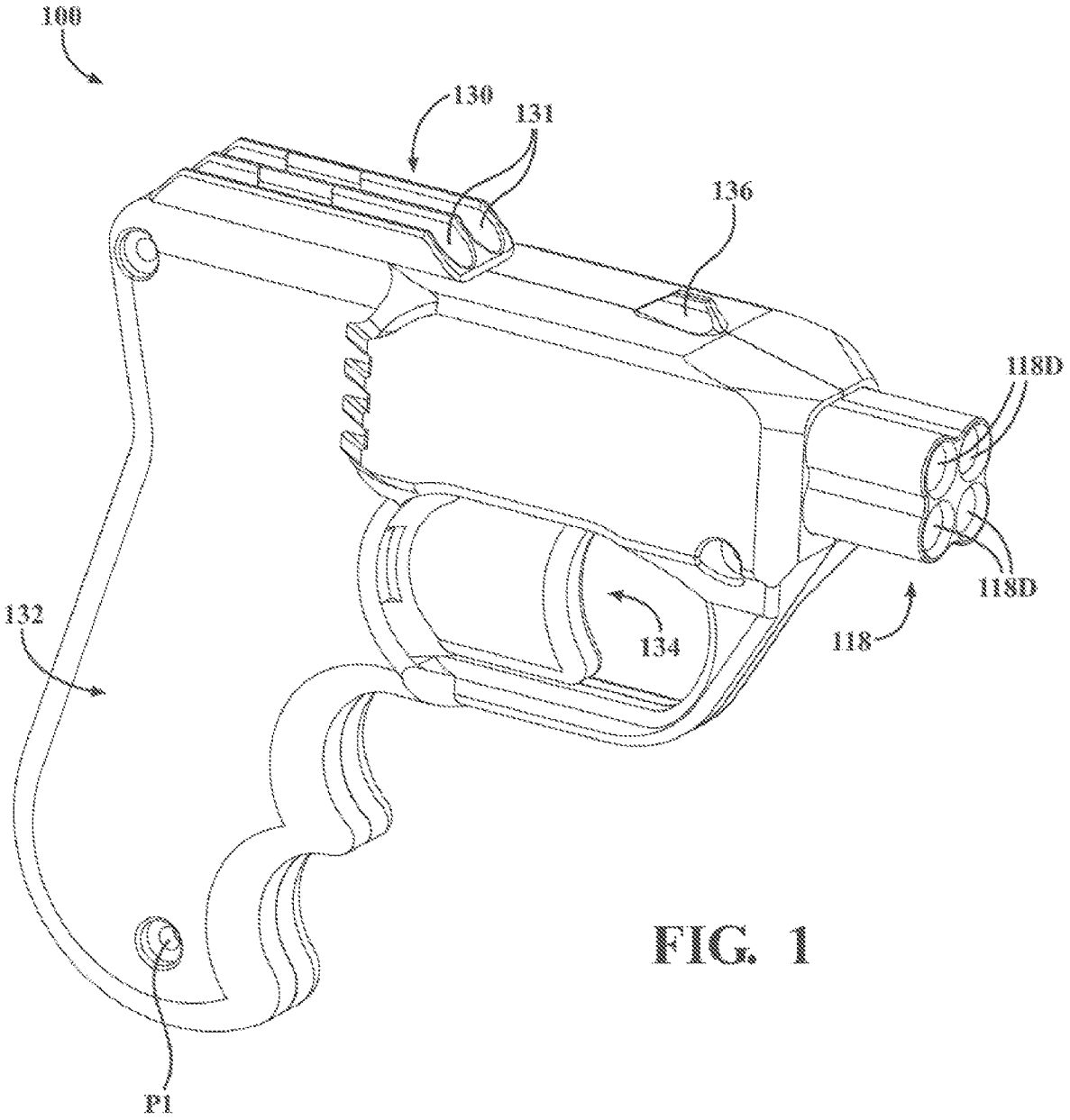
FIG. 1 schematically depicts a perspective view of an embodiment of a four shooter toy dart gun according to one or more embodiments shown or described herein.
Figure 2:
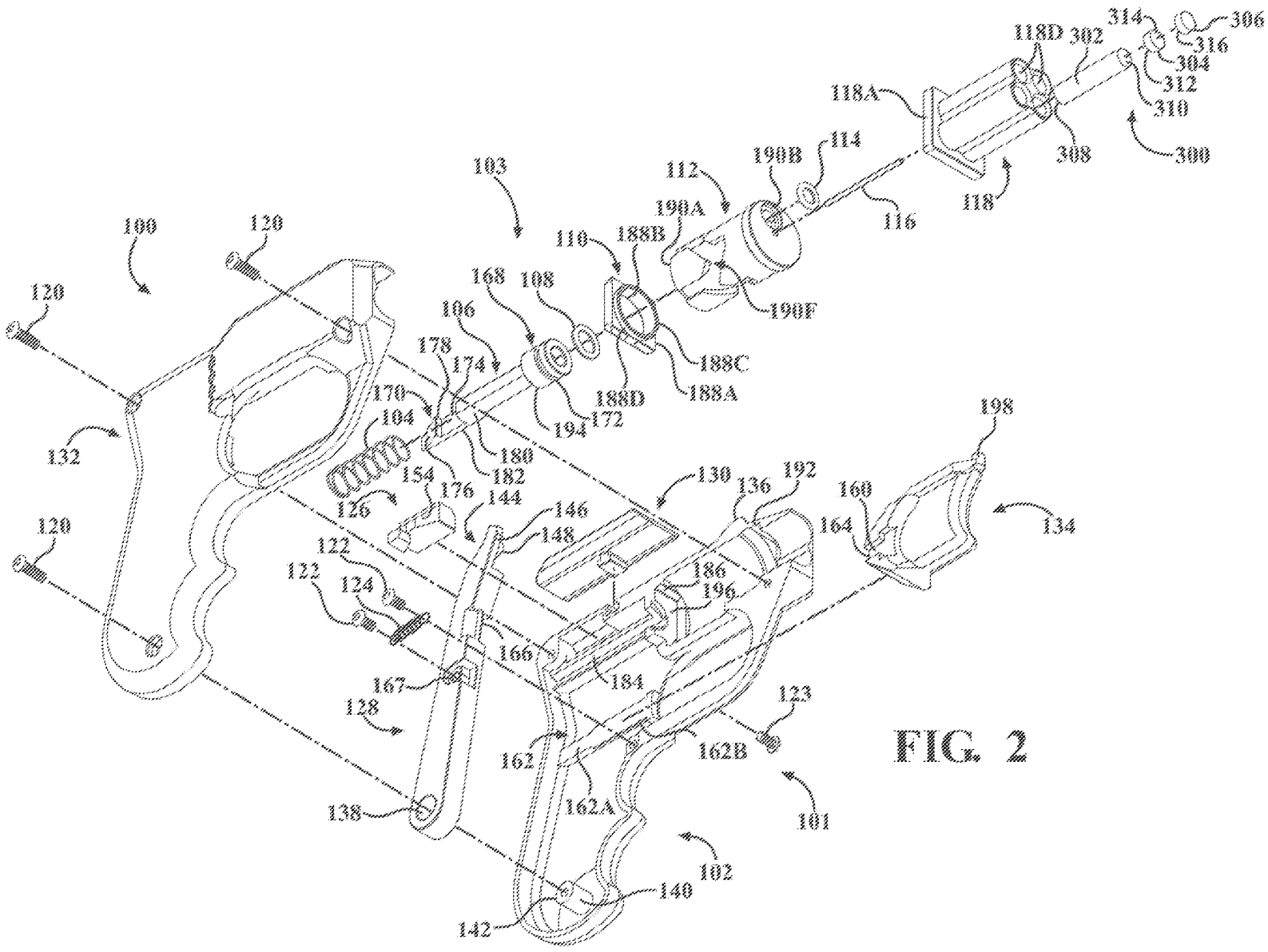
FIG. 2 schematically depicts an exploded view of the four shooter toy dart gun of FIG. 1.
Figure 9:
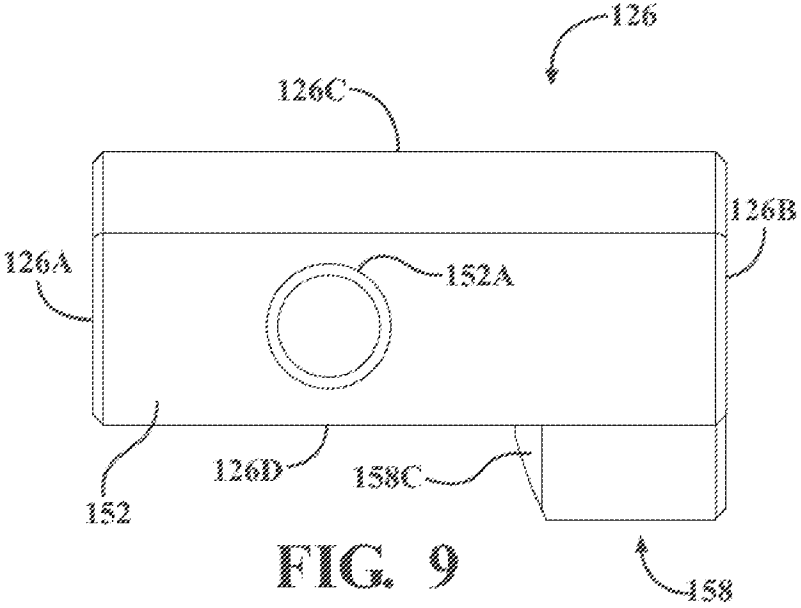
FIG. 9 schematically depicts an opposite side view of the swing arm pusher of the four shooter toy dart gun of FIG. 1, according to one or more embodiments shown or described herein.
Figure 10:
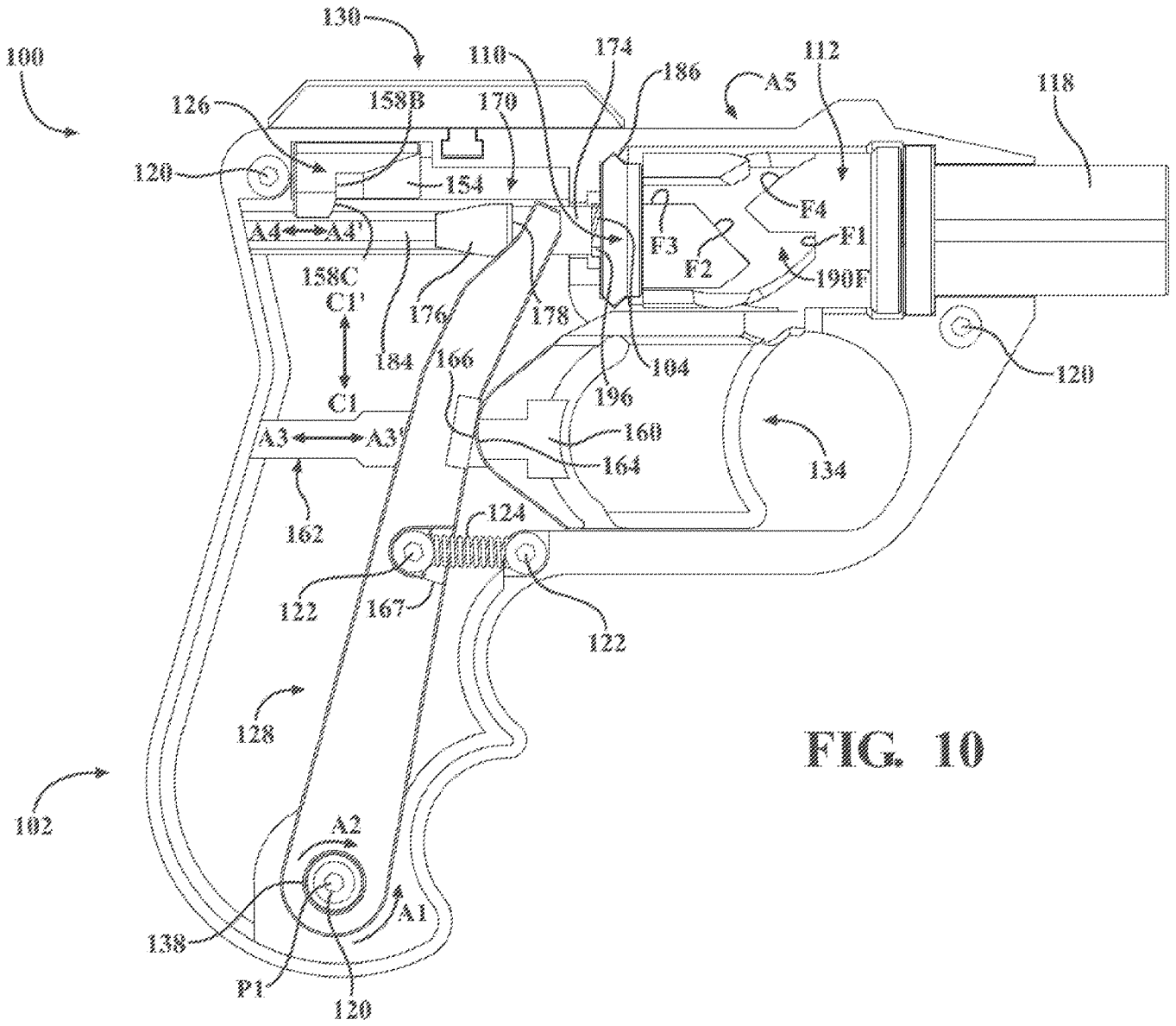
FIG. 10 schematically depicts a partial side view of the four shooter toy dart gun 10-10 of FIG. 1, according to one or more embodiments shown or described herein.

Referring now to FIGS. 1-11, specifically, FIGS. 1, 2, and 10, an embodiment of a four shot toy dart gun is generally illustrated at 100. The four shot toy dart gun 100 is a double action type toy dart gun in which a single action by a user both cocks and actuates a compression assembly to launch a dart. As such, the user is only required to perform a single action on the four shot toy dart gun 100 to launch the dart. Further, the four shot toy dart gun 100 is a semiautomatic double action type toy dart gun in which four darts are loaded into the four shot toy dart gun 100 and the four darts can be launched by four sequential depressions of the trigger by the user. Specifically, upon loading four darts into the four shot toy dart gun 100, the four darts can be sequentially launched by four sequential operations of the trigger without a separate cocking action or reloading action.

The four shot toy dart gun 100 includes a right shell 102, a large spring 104, a plunger 106, a plunger O-ring 108, a compression chamber holder 110, a compression chamber 112, a compression chamber O-ring 114, a compression chamber pin 116, a barrel 118, long fasteners (e.g. screws) 120, short fasteners (e.g. screws) 122, a small spring 124, a swing arm pusher 126, a swing arm 128, an extra dart holder 130 having a pair of barrel cavities 131, a left shell 132, a trigger 134, and an aiming sight 136. The right shell 102 and the left shell 132 are joined to form a two-piece gun shell.

The four shot toy dart gun 100 also includes a trigger assembly 101 and a compression assembly 103. The trigger assembly 101 includes the trigger 134, the swing arm 128, the small spring 124, the short fasteners 122, and the swing arm pusher 126. The trigger assembly 101 acts as both a trigger mechanism to allow the user to launch a dart 300 and a cocking mechanism to cock (i.e. actuate) the compression assembly 103 from a safe position to a launch position. The trigger assembly 101 is provided within an internal space formed by the connection of the right shell 102 and the left shell 132.

Referring to FIGS. 2 and 10, the swing arm 128 includes an aperture 138 formed at a lower end thereof. A shell shaft 140 extends inwardly from at least one of the right shell 102 and the left shell 132. The shell shaft 140 is received within the aperture 138 of the swing arm 128 such that the swing arm 128 is pivotal about a first pivot axis P1. The swing arm 128 is pivotal from a safe position, as shown in FIG. 10, to a fire position upon pivoting in the direction of arrow A1 about pivot axis P1. The swing arm 128 is pivotal from the fire position to the safe position, as shown in FIG. 10, upon pivoting in the direction of arrow A2 about pivot axis P1. In some embodiments, the shell shaft 140 includes a central aperture 142 and in which a long fastener 120 extends through the right shell 102, the central aperture 142 of the shell shaft 140, and the left shell 132 to secure the swing arm 128 to the right shell 102 and the left shell 132.

The swing arm 128 further includes an engagement portion 144 opposite the aperture 138. The engagement portion 144 includes an engagement surface 146 and an engagement knob 148 that extends outwardly from the engagement surface 146.

Figure 8:
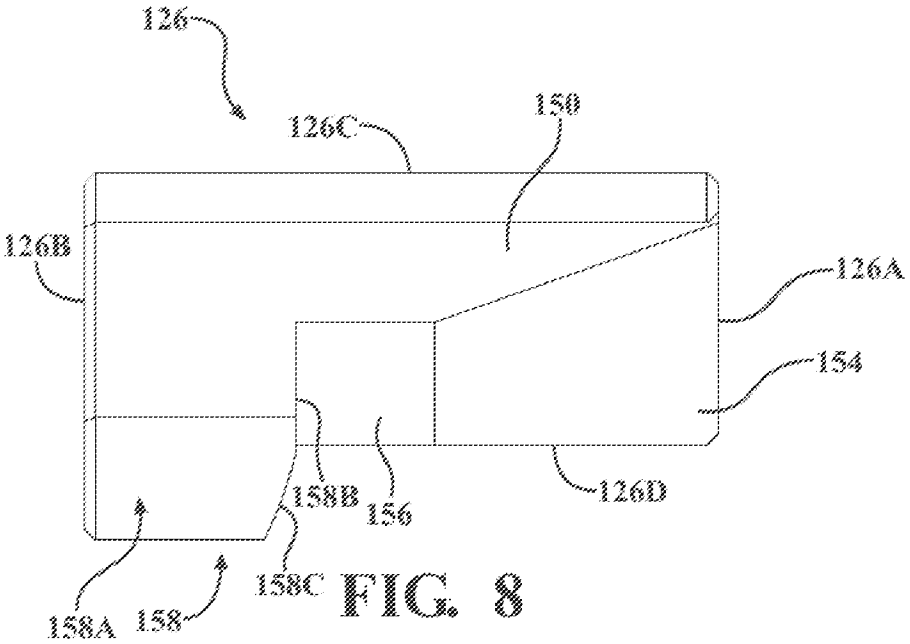
FIG. 8 schematically depicts a side view of a swing arm pusher of the four shooter toy dart gun of FIG. 1, according to one or more embodiments shown or described herein.

Referring to FIGS. 2, 8, and 9, the swing arm pusher 126 includes a front surface 126A, an opposite rear surface 126B, a top surface 126C, and an opposite bottom surface 126D. The swing arm pusher 126 further includes an engagement side surface 150 and an opposite shell side surface 152. The swing arm pusher 126 includes an inclined surface 154 and a discharge surface 156. The inclined surface 154 extends between the front surface 126A and the discharge surface 156 such that the discharge surface 156 is spaced apart from the engagement side surface 150. In some embodiments, the swing arm pusher 126 is received within a cavity formed in at least one of the right shell 102 and the left shell 132. In some embodiments, the shell side surface 152 includes a protrusion 152A that is received within a cavity within one of the right shell 102 and the left shell 132. In some embodiments, the swing arm pusher 126 is secured to at least one of the right shell 102 and the left shell 132 by a small screw 123.

A projection 158 projects outwardly from the engagement side surface 150. The projection 158 includes an outer surface 158A that is spaced apart from the discharge surface 156. An abutment ledge 158B extends between the discharge surface 156 and the outer surface 158A of the projection 158. In operation, the abutment ledge 158B contacts the engagement portion 144 of the swing arm 128 to inhibit the swing arm 128 from pivoting about pivot axis P1 in the direction of arrow A1. Specifically, the swing arm 128 contacts the abutment ledge 158B to prevent further pivoting of the swing arm 128 in the direction of arrow A1. The projection 158 further includes a depression surface 158C, as best seen in FIG. 8, on a bottom side thereof. The depression surface 158C contacts the plunger 106, as discussed herein.

Referring to FIGS. 2 and 10, the trigger 134 includes side channels 160 provided on either side of the trigger 134. The side channels 160 are configured to engage with tracks 162 provided on an interior side of each of the right shell 102 and the left shell 132, as shown in FIGS. 2 and 10. In some embodiments, the tracks 162 are formed having a generally T-shape with a post section 162A extending inwardly from the inner surface of the right shell 102 and the left shell 132 and a flange section 162B that extends outwardly from a distal end of the post section 162A such that the flange section 162B is spaced apart from the inner surface of the right shell 102 and the left shell 132.

The engagement of the tracks 162 and the side channels 160 of the trigger 134 allow the trigger 134 to be linearly displaced in the direction of arrows A3 and A3' between an undepressed position and a depressed position. A contact face 164 at a rear end of the trigger 134 is in abutting contact with a contact surface 166 of the swing arm 128.

As shown in FIG. 10, the small spring 124 has one end secured to at least one of the right shell 102 and the left shell 132 by one short fastener 122 and an opposite end secured to the swing arm 128 by another short fastener 122. In some embodiments, the swing arm 128 includes a spring recess 167 at which the swing arm end of the small spring 124 is secured to the swing arm 128. The small spring 124 biases the swing arm 128 toward the safe position.

In the undepressed position, the trigger 134 is not actuated and the swing arm 128 is in the safe position due to the biasing force of the small spring 124. In the depressed position, the trigger 134 is linearly displaced along the tracks 162 in the direction of arrow A3. Specifically, the trigger 134 is depressed by a user and the swing arm 128 overcomes the biasing force of the small spring 124 and pivots about pivot axis P1 in the direction of arrow A1 due to the contact between the contact face 164 of the trigger 134 and the contact surface 166 of the swing arm 128.

Upon release of the trigger 134 in the depressed position, the swing arm 128 is biased toward the safe position by the biasing force of the small spring 124 and the swing arm 128 pivots about pivot axis P1 in the direction of arrow A2. Due to the abutting contact between the contact face 164 of the trigger 134 and the contact surface 166 of the swing arm 128, the trigger 134 is linearly displaced along the tracks 162 in the direction of arrow A3' from the depressed position to the undepressed position.

Referring to FIGS. 2 and 10, the compression assembly 103 includes the large spring 104, the plunger 106, the plunger O-ring 108, the compression chamber holder 110, the compression chamber 112, the compression chamber O-ring 114, the compression chamber pin 116, and the barrel 118. The compression assembly 103 is moveable between an uncompressed (i.e. safe) position and a compressed (i.e. launch) position upon movement of the plunger 106 between a retracted position and an extended position. In the retracted position, a portion of the plunger 106 positioned within the compression chamber 112 is greater than a portion of the plunger 106 positioned within the compression chamber 112 when in the extended position.

Referring to FIGS. 2 and 10, the plunger 106 includes a head portion 168 at one end and a hook portion 170 at an opposite end. The head portion 168 includes a plunger O-ring groove 172 in which the plunger O-ring 108 is received. A portion of the plunger 106, including the head portion 168, is positioned within the compression chamber 112, as described in more detail herein. The plunger 106 including the plunger O-ring 108 attached to the head portion 168 at the plunger O-ring groove 172 and is received within the compression chamber 112. The plunger O-ring 108 on the head portion 168 of the plunger 106 provides an airtight seal with an interior surface of the compression chamber 112.

The hook portion 170 of the plunger 106 includes a recess 174, a tapered surface 176, and a plunger ledge 178. The plunger 106 also includes a plunger shaft 180 that connects the hook portion 170 to the head portion 168. In some embodiments, the hook portion 170 of the plunger 106 includes a ridge 182 provided opposite the recess 174 and the tapered surface 176. The ridge 182 is received within a track 184 formed on at least one of the right shell 102 and the left shell 132 to guide the plunger 106 to be linearly displaced in the direction of arrows A4 and A4'.

The compression chamber holder 110 is received within a chamber holder seat 186 in at least one of the right shell 102 and the left shell 132. The chamber holder seat 186 has a shape that corresponds to an outer shape 188A of the compression chamber holder 110 to retain the compression chamber holder 110 within the right shell 102 and the left shell 132. The compression chamber holder 110 also includes a plunger opening 188B and an opposite compression chamber opening 188C. An annular ring 188D extends from a front side of the compression chamber holder 110.

Referring to FIGS. 2, 3-5, and 10, the compression chamber 112 includes a holder opening 190A and an opposite barrel opening 190B. An annular chamber ring 190C is provided around the holder opening 190A such that the annular ring 188D of the compression chamber holder 110 is received within the annular chamber ring 190C of the compression chamber 112. In some embodiments, the annular chamber ring 190C is received within the annular ring 188D of the compression chamber holder 110. A passageway extends between the holder opening 190A and the barrel opening 190B. In operation, the head portion 168 of the plunger 106 extends through the compression chamber holder 110 and into the compression chamber 112. Specifically, the head portion 168 of the plunger 106 extends through the plunger opening 188B and the compression chamber opening 188C of the compression chamber holder 110 and through the holder opening 190A of the compression chamber 112.

The compression chamber 112 includes a chamber O-ring groove 190D that surrounds the barrel opening 190B. The compression chamber O-ring 114 is received within the chamber O-ring groove 190D of the compression chamber 112. A pin hole 190E is provided on the front surface of the compression chamber 112. The compression chamber O-ring 114 contacts a rear surface of the barrel 118 and forms a seal between the barrel opening 190B and the barrel 118.

A pathway 190F is recessed into an outer surface of the compression chamber 112. The pathway 190F includes four safe recesses F1, four fire inclined surfaces F2, four fire paths F3, and four return inclined surfaces F4. The four fire paths F3 extend to a rear edge 190H of the compression chamber 112. In some embodiments, the four fire paths F3 are equidistantly spaced apart from one another to permit equal, incremental rotation, as described herein. It is appreciated that although only one side of the compression chamer 112 is illustrated, the pathway 190F, including the safe recesses F1, the fire inclined surfaces F2, the fire paths F3, and the return inclined surfaces F4, extends circumferentially around the outer surface of the compression chamber 112.

As shown in FIGS. 1, 2, 6, and 7, the barrel 118 includes an outer portion 118A that has a shape that corresponds to a barrel seat 192 provided in at least one of the right shell 102 and the left shell 132. The barrel 118 includes four chamber openings 118B on a rear side and four dart openings 118D on a front side. Each one of the four chamber openings 118B extend to one of the four dart openings 118D. Struts 118C are provided on each of the four chamber openings 118B. In some embodiments, an elongated protrusion 118E is provided on a front surface of the each of the struts 118C. Each of the elongated protrusions 118E extend coaxial along at least a portion of the hollow chambers of the barrel 118. The elongated protrusions 118E are provided to be positioned within a portion of the dart 300. The barrel 118 includes a pin hole 118F provided on the rear side of the barrel 118.

The compression assembly 103 is assembled by inserting the plunger shaft 180 of the plunger 106 into the large spring 104, attaching the plunger O-ring 108 to the plunger O-ring groove 172 of the head portion 168, inserting the head portion 168 of the plunger 106 through the compression chamber holder 110 and into the compression chamber 112. The compression assembly 103 is then positioned within the inner cavity formed by the right shell 102 and the left shell 132 such that one end of the large spring 104 abuts against a rear surface 194 of the head portion 168 and the opposite end contacts a spring seat 196 formed in at least one of the right shell 102 and the left shell 132, the outer shape 188A of the compression chamber holder 110 is provided within the chamber holder seat 186, the annular ring 188D is inserted into the annular chamber ring 190C of the compression chamber 112, one end of the compression chamber pin 116 is inserted into the pin hole 190E and an opposite end of the compression chamber pin 116 is inserted into the pin hole 190E of the barrel 118, the holder opening 190A is received within the chamber holder seat 186, and a guide 198 of the trigger 134 is received within the pathway 190F of the compression chamber 112. The right shell 102 and the left shell 132 are then secured together using the long fasteners 120.

The insertion of one of the annular ring 188D and the annular chamber ring 190C within the other of the annular ring 188D and the annular chamber ring 190C and the insertion of the compression chamber pin 116 into the pin hole 190E and the pin hole 118F allows the compression chamber 112 to rotate 360°. Upon aligning the barrel opening 190B with one of the four chamber openings 118B of the barrel 118, subsequent rotation of the compression chamber 112 by 90° will align the other of the four chamber openings 118B of the barrel 118 with the barrel opening 190B.

Figure 11C:
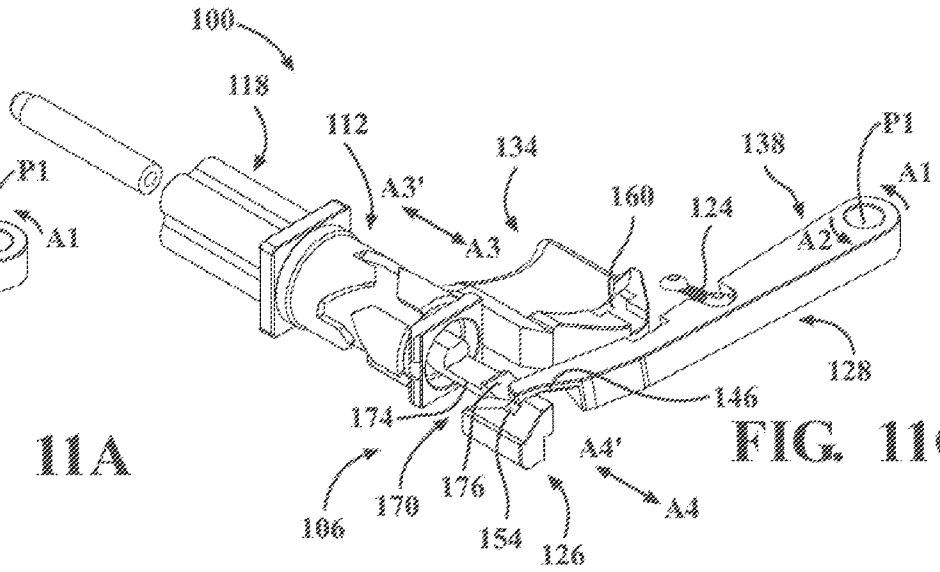
FIG. 11C schematically depicts an operation of four shooter toy dart gun of FIG. 1 with the trigger mechanism in the depressed position and the compression mechanism in the uncompressed position, according to one or more embodiments shown or described herein.
Figure 11A:
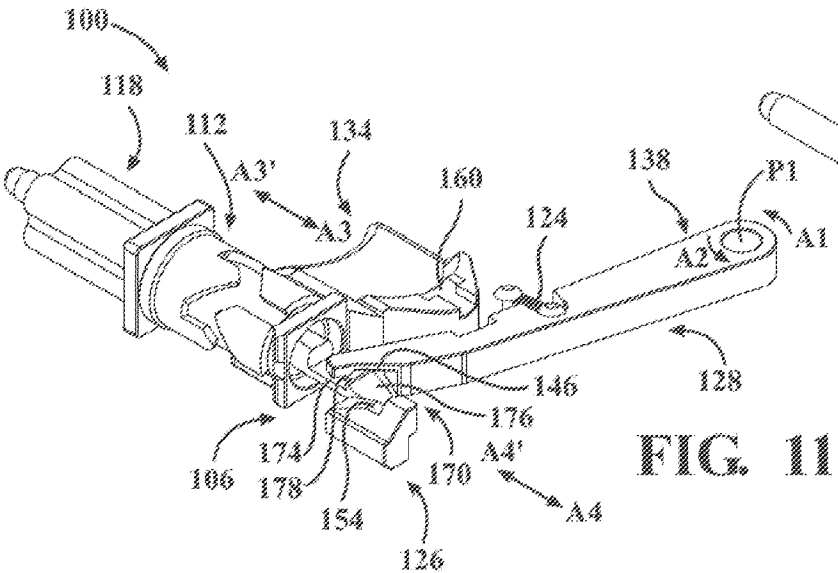
FIG. 11A schematically depicts an operation of the four shooter toy dart gun of FIG. 1 with a trigger mechanism in an undepressed position and a compression mechanism in an uncompressed position, according to one or more embodiments shown or described herein.

Referring to FIGS. 3, 10, and 11A-11D, operation of the four shot toy dart gun 100 will now be described. In an initial state, as shown in FIGS. 10 and 11A, the trigger assembly 101 is in a safe position, specifically, the trigger 134 is in the undepressed position, the swing arm 128 is in the safe position, and the compression assembly 103 is in an uncompressed position, specifically, the plunger 106 is in the retracted position. In the initial state, the engagement knob 148 of the swing arm 128 is at least partially received within the recess 174 of the hook portion 170 of the plunger 106. The engagement knob 148 is retained within the recess 174 by the plunger ledge 178. As the swing arm 128 is in the safe position, the engagement portion 144 of the swing arm 128 is spaced apart from the swing arm pusher 126. In the initial state, the guide 198 of the trigger 134 is in a safe recess F1 such that the barrel opening 190B is positioned between two of the four chamber openings 118B, specifically, the barrel opening 190B is positioned 45° between two adjacent chamber openings 118B.

Figure 3:
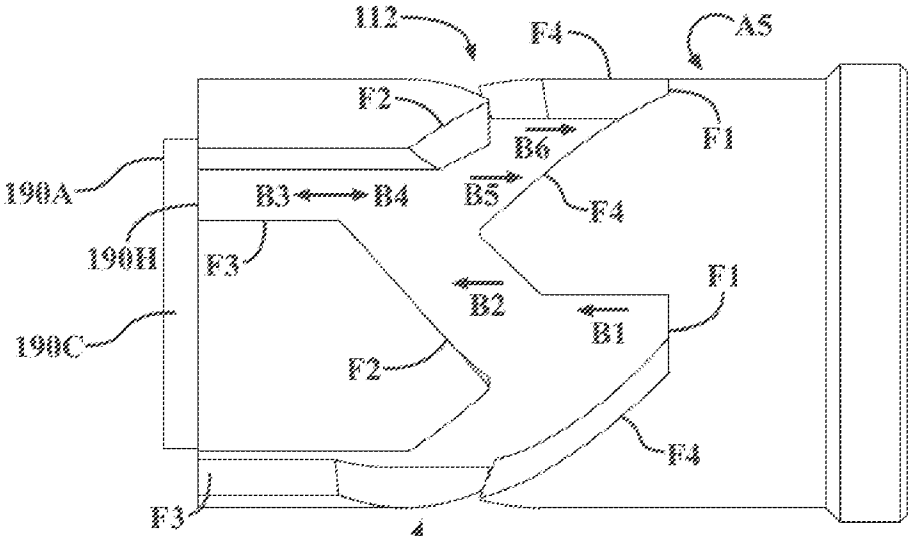
FIG. 3 schematically depicts a side view of a compression chamber of the four shooter toy dart gun of FIG. 1, according to one or more embodiments shown or described herein.
Figure 5:
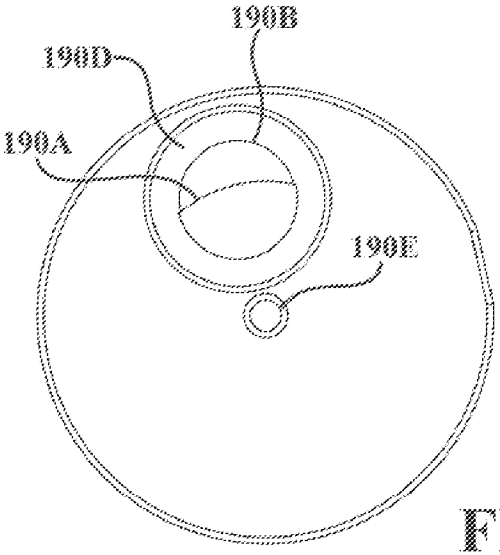
FIG. 5 schematically depicts a front view of the compression chamber of FIG. 3, according to one or more embodiments shown or described herein.
Figure 4:
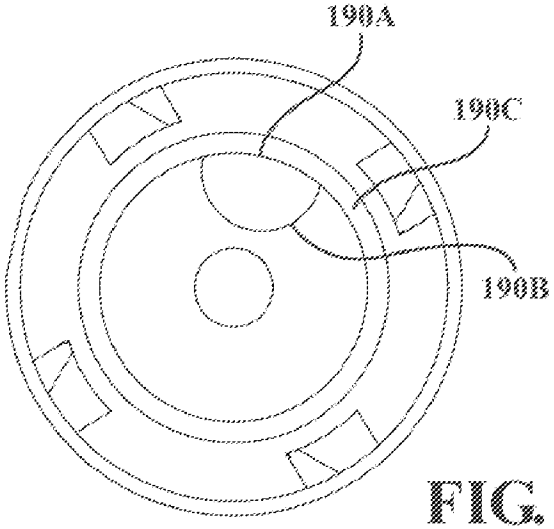
FIG. 4 schematically depicts a rear view of the compression chamber of FIG. 3, according to one or more embodiments shown or described herein.
Figure 11D:
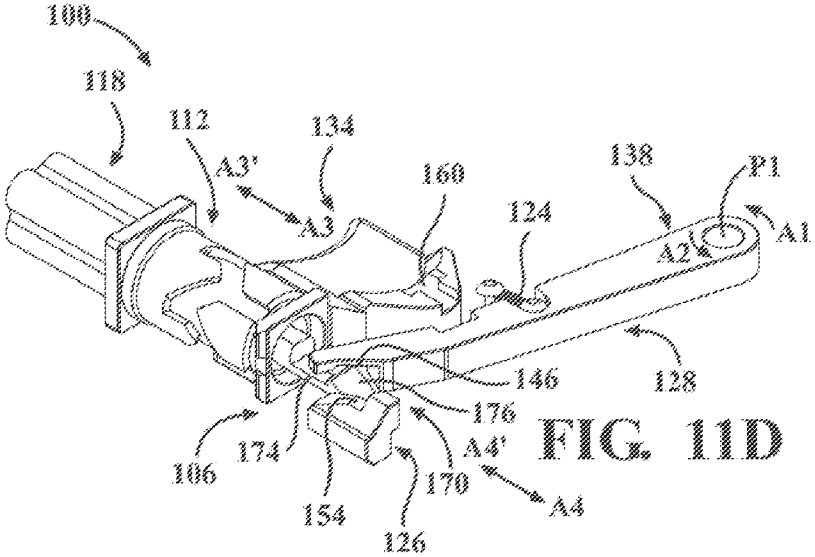
FIG. 11D schematically depicts an operation of four shooter toy dart gun of FIG. 1 with the trigger mechanism in the undepressed position and the compression mechanism in the uncompressed position, according to one or more embodiments shown or described herein.
Figure 11B:
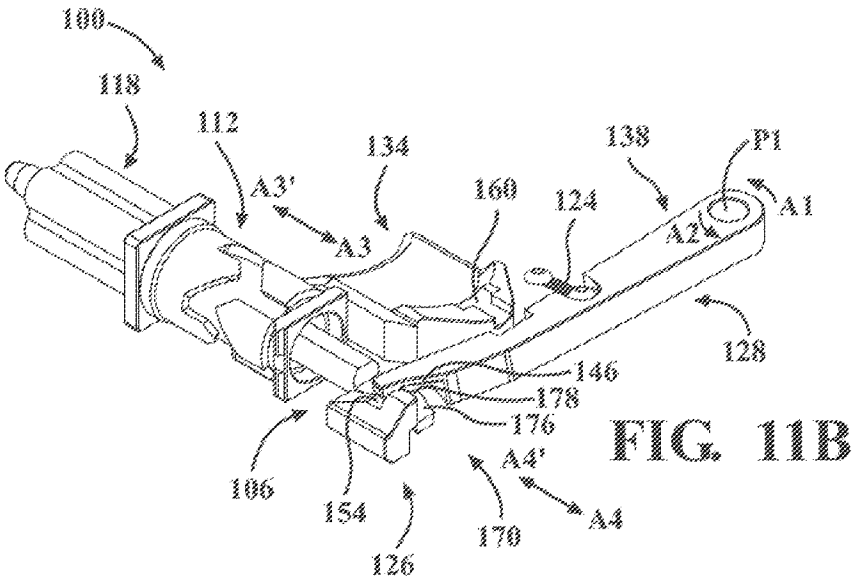
FIG. 11B schematically depicts an operation of four shooter toy dart gun of FIG. 1 with the trigger mechanism in a depressed position and the compression mechanism in a compressed position, according to one or more embodiments shown or described herein.

As shown in FIGS. 3, 10 and 11B, upon depression of the trigger 134 by a user in the direction of arrow A3, the trigger 134 pushes the swing arm 128 to overcome the biasing force of the small spring 124 and pivots the swing arm 128 in the direction of arrow A1. Due to the engagement of the engagement knob 148 within the recess 174, the pivoting of the swing arm 128, specifically the engagement portion 144, pulls the plunger 106 in the direction of arrow A4, thereby moving the trigger 134 from the undepressed position toward the depressed position, the swing arm 128 from the safe position toward the fire position, the plunger 106 from the retracted position toward the extended position, and the compression assembly 103 from the uncompressed position toward the compressed position. Specifically, upon pivoting of the swing arm 128 in the direction of arrow A1, the engagement knob 148 contacts the plunger ledge 178, overcomes the biasing force of the large spring 104, and pushes the plunger 106 in the direction of arrow A4.

Upon depression of the trigger 134 by a user in the direction of arrow A3, the guide 198 is moved rearward in the direction of arrow B1 until the guide 198 contacts the fire inclined surface F2. Upon contact with the fire inclined surface F2 the guide 198 slides along the fire inclined surface in the direction of arrow B2, the contact between the guide 198 and the fire inclined surface F2 causes the compression chamber 112 to rotate in the direction of arrow A5. The movement of the guide 198 along the fire inclined surface F2 rotates the barrel 118 45° such that upon the guide 198 entering the fire path F3 the barrel opening 190B is aligned with one of the chamber openings 118B. Further, the compression chamber O-ring 114 provides a seal between the compression chamber 112 and the barrel 118.

As shown in FIGS. 3, 10, and 11B, continued depression of the trigger 134 in the direction of arrow A3 displaces the guide 198 in the direction of arrow B3 in the fire path F3 and brings the engagement portion 144 of the swing arm 128 into contact with the swing arm pusher 126. Specifically, the engagement surface 146 of the engagement portion 144 contacts the inclined surface 154 and the movement of the swing arm 128 and the plunger 106 in the direction of arrow A4 slides the engagement surface 146 along the inclined surface 154 which deflects the swing arm 128, specifically, the engagement knob 148 away from and out of the recess 174 of the plunger 106. In addition, the plunger 106 moves in the direction of arrow A4 and contacts the depression surface 158C, which deflects the hook portion 170 of the plunger 106 downward in the direction of arrow C1. The deflection of the hook portion 170 downwardly in the direction of arrow C1 facilitates the disengagement of the engagement knob 148 and the recess 174. Upon disengagement of the engagement knob 148 from the recess 174, the plunger 106 moves in the direction of arrow A4' and the plunger 106 slides upwardly in the direction of arrow C1'.

Upon movement of the engagement surface 146 along the inclined surface 154 to the discharge surface 156, the engagement knob 148 is deflected out of engagement of the recess 174, specifically, the engagement knob 148 no longer contacts the abutment ledge 158B as the engagement knob 148 has exited the recess 174. As there is no longer any contact between the engagement knob 148 and the abutment ledge 158B of the recess 174, the biasing force of the large spring 104 biases the plunger 106 from the extended position to the retracted position in the direction of arrow A4' which moves the compression assembly 103 from the compressed position to the uncompressed position due to the movement of the head portion 168 of the plunger 106 within the compression chamber 112 which compresses the air within the compression chamber 112.

As shown in FIGS. 3, 10, and 11C, the air compressed by the movement of the plunger 106 from the extended position to the retracted position travels through the compression chamber 112 through the barrel opening 190B, through one of the chamber openings 118B, and propels the dart 300 to exit one of the dart openings 118D of the barrel 118. Accordingly, the four shot toy dart gun 100 is configured to launch the dart 300 by the single action of actuating the trigger 134 from the undepressed position to the depressed position without a prior or separate cocking action.

As shown in FIGS. 3, 10, and 11D, the biasing force of the large spring 104 moves the plunger 106 from the extended position to the retracted position in the direction of arrow A4'. Thereafter, upon release of the trigger 134 by the user, the biasing force of the small spring 124 biases the swing arm 128 in the direction of arrow A2 from the fire position to the safe position, which moves the engagement portion 144 in the direction of arrow A4' such that the engagement knob 148 slides along the tapered surface 176 until the engagement knob 148 is received within the recess 174. Further, the trigger 134 is moved in the direction of arrow A3' due to the contact between the trigger 134 and the swing arm 128 to bring the trigger 134 into the undepressed position.

The movement of the trigger 134 in the direction of arrow A3' moves the guide 198 in the direction of arrow B4 until the guide 198 contacts the return inclined surfaces F4. The guide 198 slides along the return inclined surface F4 in the direction of arrow B5 which rotates the compression chamber 112 in the direction of arrow A5 until the guide 198 enters the safe recess F1 in the direction of arrow B6 which rotates the compression chamber 112 45° such that the barrel opening 190B is rotated 45° out of alignment with one of the chamber openings 118B in which the dart 300 was launched to be between two adjacent chamber openings 118B.

As such, the trigger 134 is in the undepressed position, the swing arm 128 is in the safe position, and the plunger 106 is in the retracted position. Therefore, the four shot toy dart gun 100 is ready to be fired again upon loading a dart 300 into the barrel 118 and subsequent depression of the trigger 134.

In some embodiments, the guide 198 is positioned on a front side of the trigger 134 and the guide 198 contacts the return inclined surfaces F4. In some other embodiments, the guide 198 includes a rounded surface that contacts the safe recesses F1, the fire inclined surfaces F2, the fire paths F3, and the return inclined surfaces F4. In some embodiments, the guide 198 is positioned on a rear side of the trigger 134 and the rounded surface contacts the safe recesses F1, the fire inclined surfaces F2, the fire paths F3.

Referring to FIG. 2, in some embodiments, the dart 300 is a foam tipped dart. The foam tipped dart 300 is configured for use with the four shot toy dart gun 100. The foam tipped dart 300 includes a tube 302, a front insert 304, and a foam tip 306. The tube 302 is a generally hollow cylindrical tube having a rear opening 308 and an opposite front opening 310. In some embodiments, the tube 302 is composed of a plastic or polymer material and may be formed by injection molding or extruding. In some embodiments, the tube 302 is formed of a foam material, and may be dimensioned such that the outer surface of the tube 302 is in contact with the interior surface of one of the dart openings 118D of the barrel 118 when the foam tipped dart 300 is inserted therein.

The front insert 304 includes a rear section 312 and a collar 314. The rear section 312 has a diameter that is less than a diameter of the front opening 310 of the tube 302 such that the rear section 312 of the front insert 304 is at least partially received within the tube 302 through the front opening 310. In some embodiments, the collar 314 has a diameter larger than the diameter of the tube 302 such that a portion of the collar 314 abuts the tube 302 adjacent the front opening 310. The foam tip 306 includes a recess 316 that receives at least a portion of the front insert 304. The foam tip 306 provides a soft covering for the foam tipped dart 300. The front insert 304 has a weight that is greater than the weight of the foam tip 306 to provide flight stability and increase a distance that the foam tipped dart 300 is configured to be launched by the four shot toy dart gun 100. In some embodiments, the foam tip 306 may be replaced by a suction cup to provide a suction tip dart.

Figure 7:
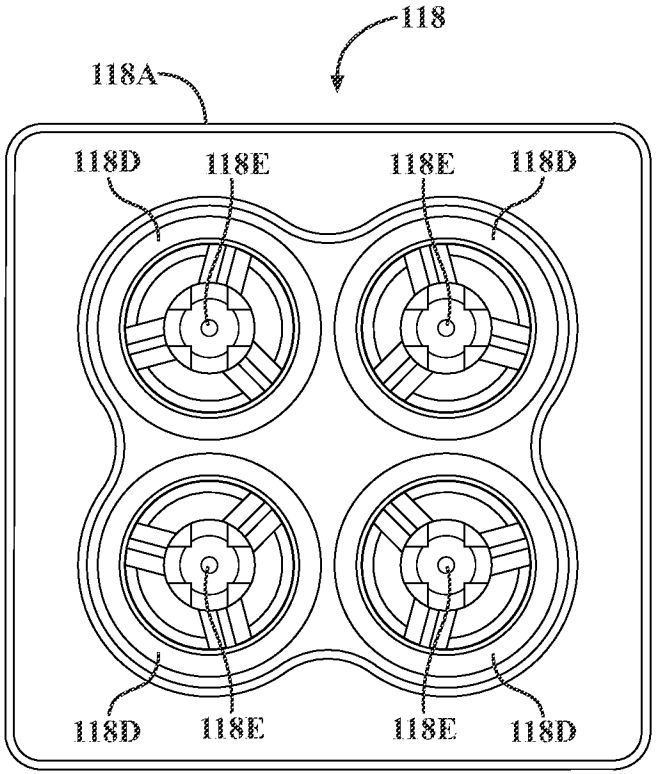
FIG. 7 schematically depicts a front view of the barrel of the four shooter toy dart gun of FIG. 1, according to one or more embodiments shown or described herein.
Figure 6:
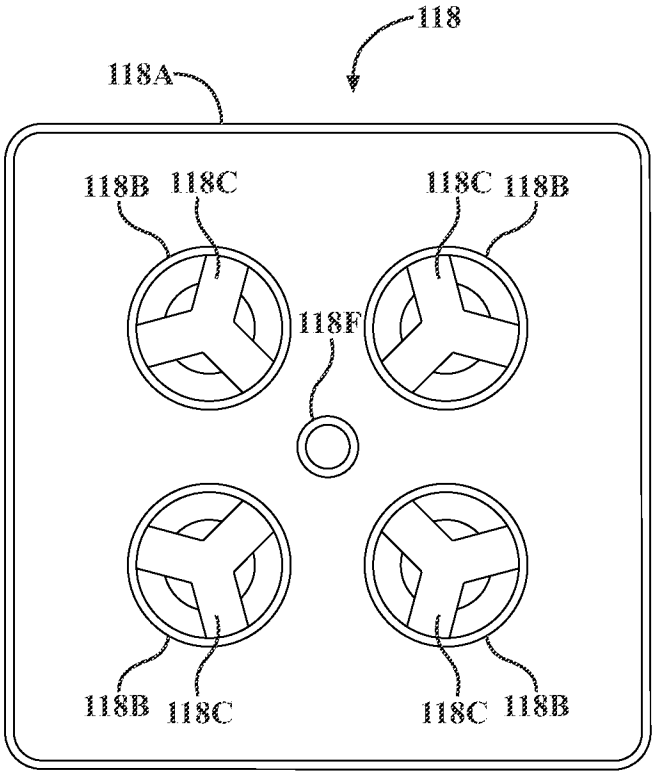
FIG. 6 schematically depicts a rear view of a barrel of the four shooter toy dart gun of FIG. 1, according to one or more embodiments shown or described herein.

Referring to FIGS. 2 and 7, during operation, the foam tipped dart 300 is inserted into one of the dart openings 118D of the barrel 118 such that the elongated protrusion 118E is received within the rear opening 308 and extends at least partially through the tube 302. In some embodiments, the tube 302 is dimensioned such that the elongated protrusion 118E is not in contact with the interior surface of the tube 302 and that the interior surface of the dart opening 118D of the barrel 118 is not in contact with the outer surface of the tube 302.

Figure 12:
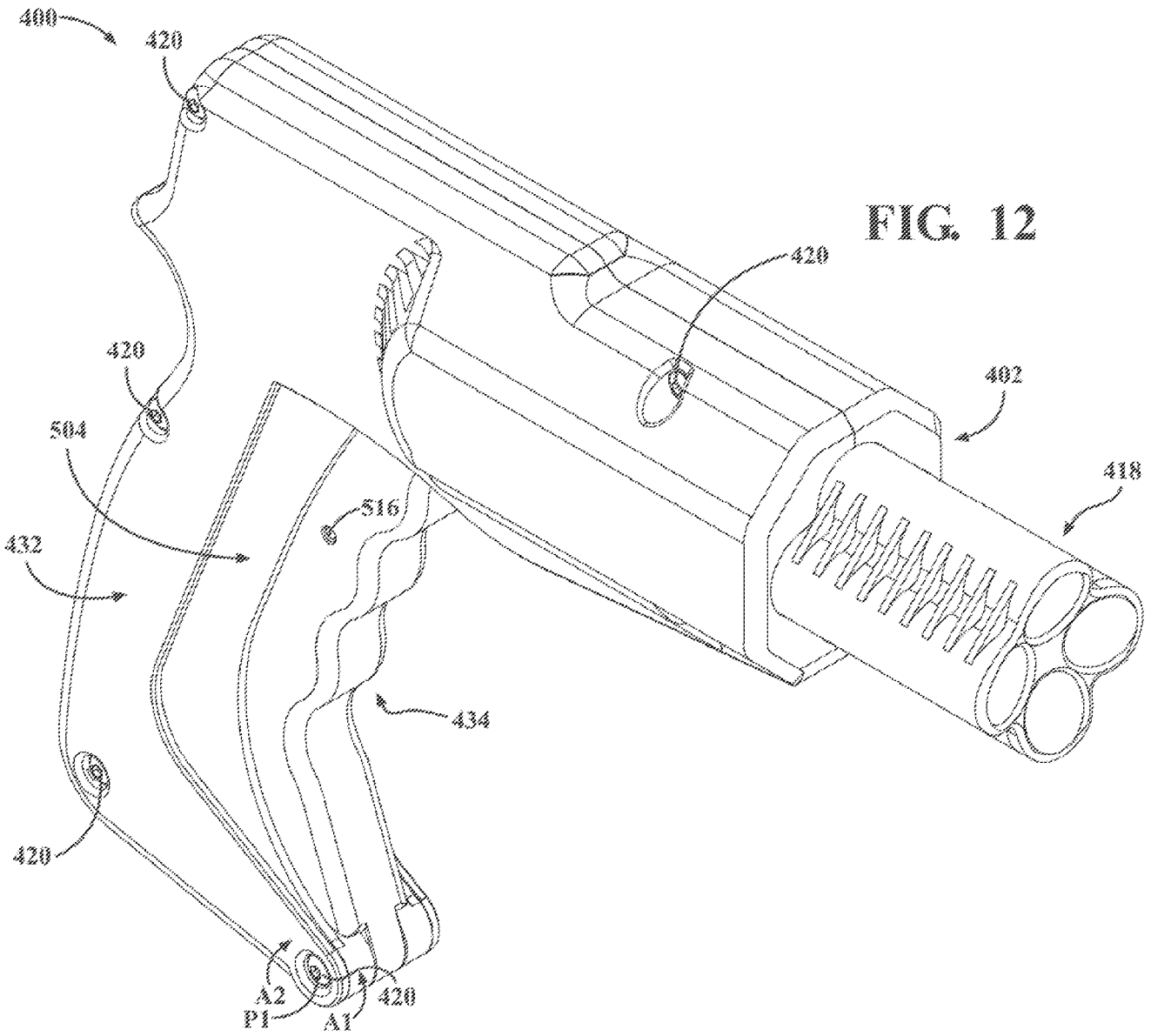
FIG. 12 schematically depicts a perspective view of another embodiment of a four shooter toy dart gun, according to one or more embodiments shown or described herein.
Figure 13:
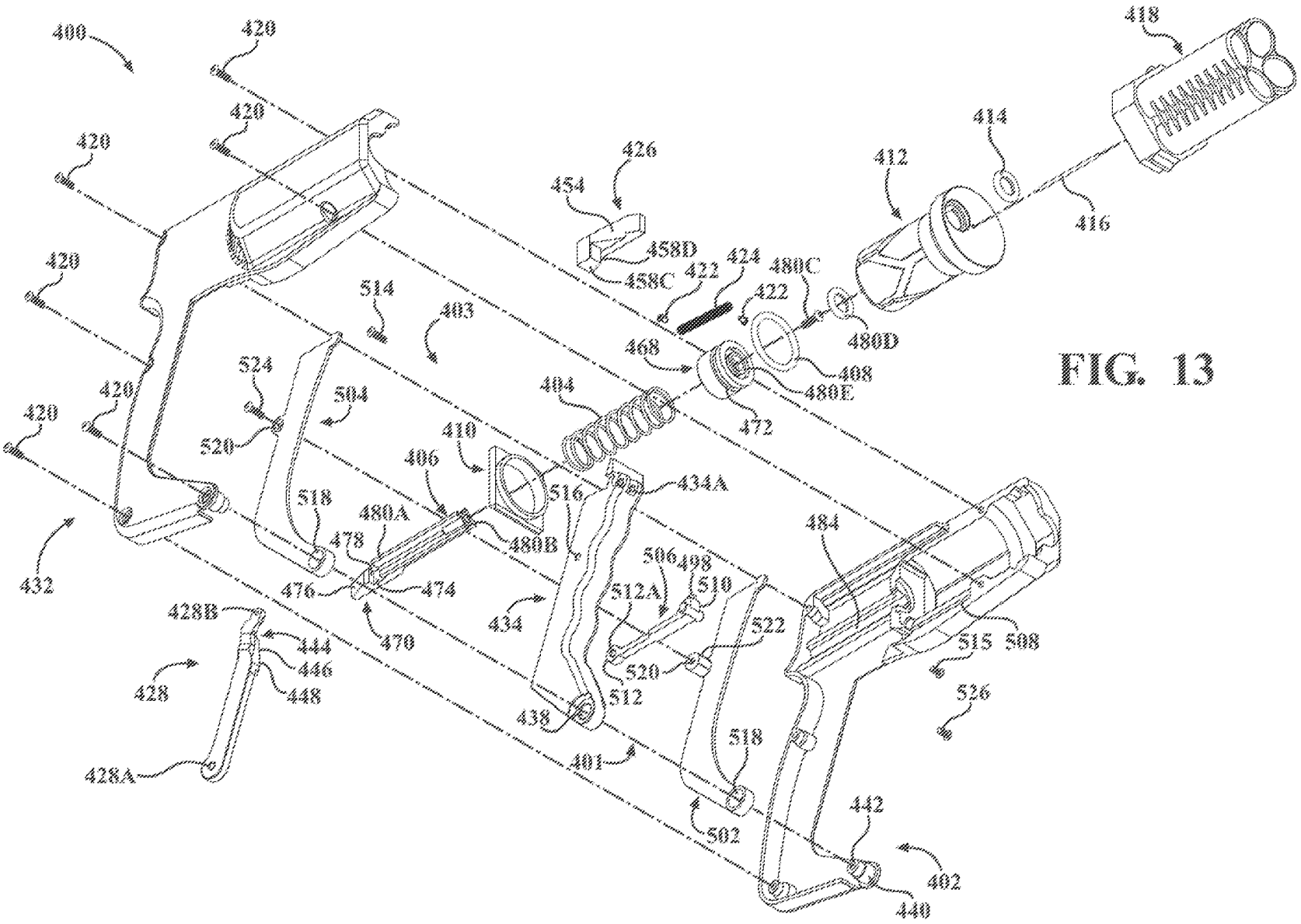
FIG. 13 schematically depicts an exploded view of the four shooter toy dart gun of FIG. 12, according to one or more embodiments shown or described herein.
Figure 14:
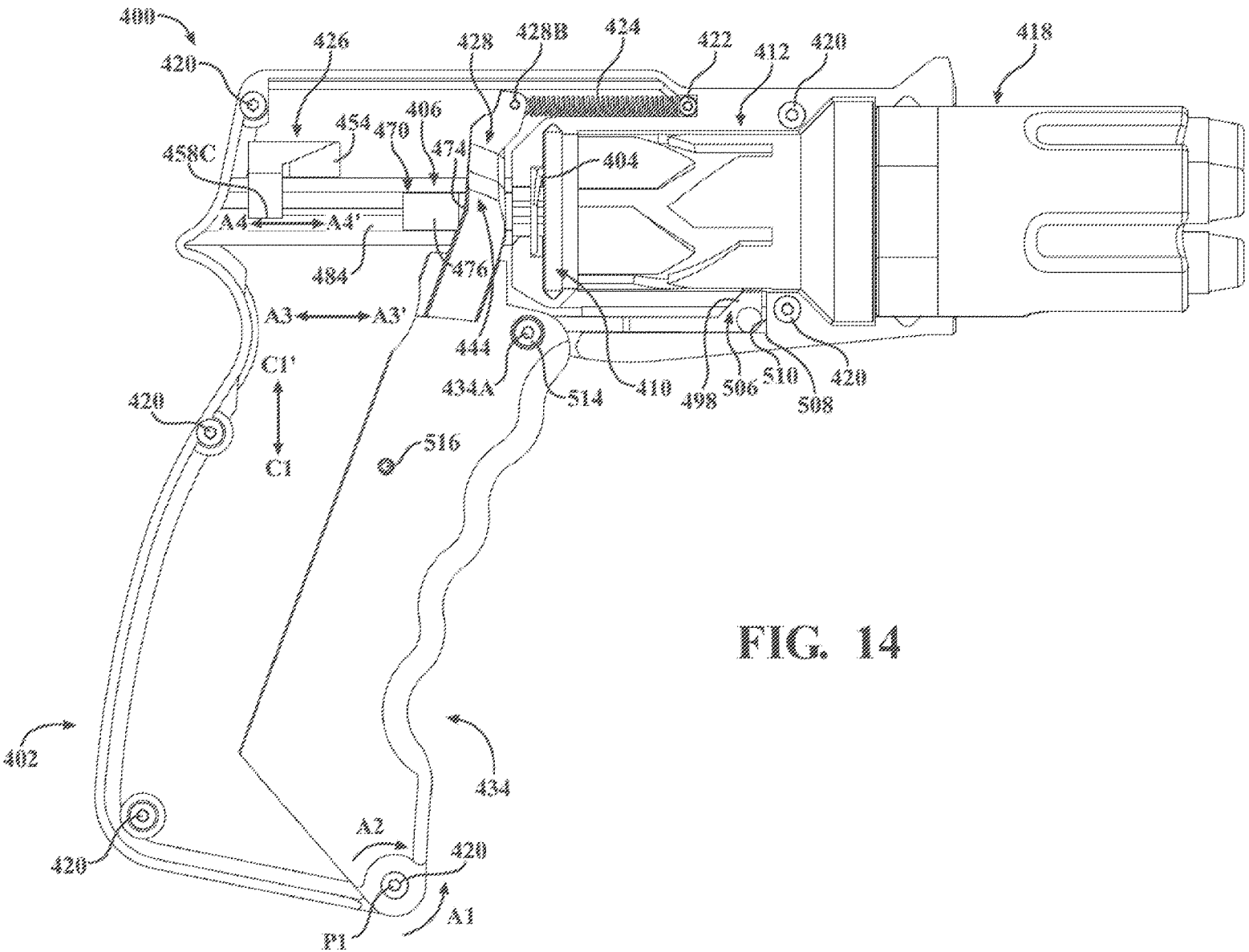
FIG. 14 schematically depicts a partial side view of the four shooter toy dart gun of FIG. 12, according to one or more embodiments shown or described herein.
Figure 15:
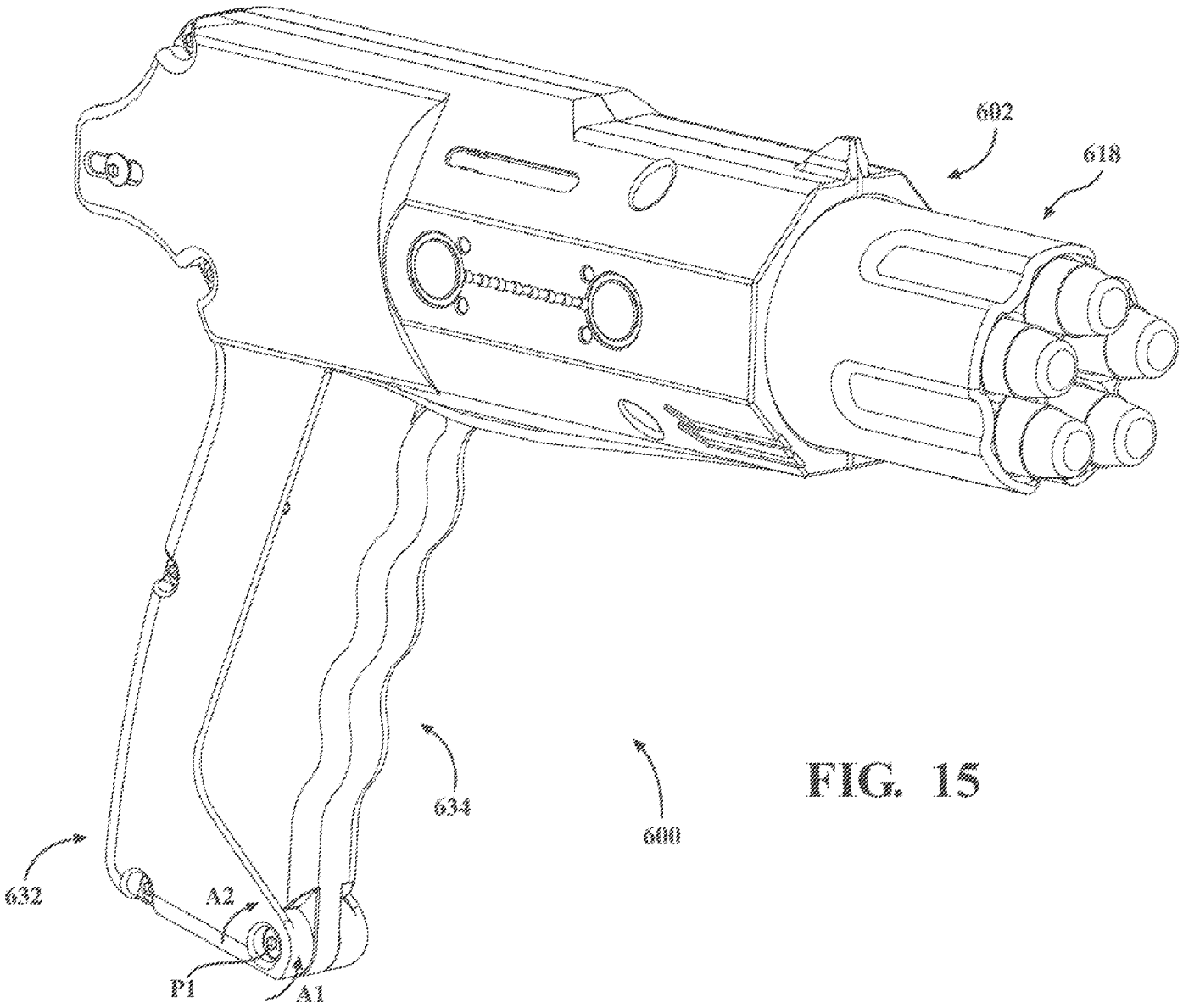
FIG. 15 schematically depicts a perspective view of an embodiment of a five shooter toy dart gun, according to one or more embodiments shown or described herein.

Referring to FIGS. 12-14, an embodiment of a four shot toy dart gun is generally illustrated at 400. The four shot toy dart gun 400 is a double action type toy dart gun in which a single action by a user both cocks and actuates a compression assembly to launch a dart. As such, the user is only required to perform a single action on the four shot toy dart gun 400 to launch the dart. Further, the four shot toy dart gun 400 is a semiautomatic double action type toy dart gun in which four darts are loaded into the four shot toy dart gun 400 and the four darts can be launched by four sequential depressions of the trigger by the user. Specifically, upon loading four darts into the four shot toy dart gun 400, the four darts can be sequentially launched by four sequential operations of the trigger without a separate cocking action or reloading action.

The four shot toy dart gun 400 includes a right shell 402, a large spring 404, a plunger 406, an exterior plunger O-ring 408, a compression chamber holder 410, a compression chamber 412, a compression chamber O-ring 414, a compression chamber pin 416, a barrel 418, long fasteners (e.g. screws) 420, short fasteners (e.g. screws) 422, a small spring 424, a swing arm pusher 426, a swing arm 428, a left shell 432, a trigger 434, a right trigger guard 502, a left trigger guard 504, and a compression chamber pusher 506. The right shell 402 and the left shell 432 are joined to form a two-piece gun shell.

The four shot toy dart gun 400 also includes a trigger assembly 401 and a compression assembly 403. The trigger assembly 401 is similar to the trigger assembly 101 of the four shot toy dart gun 100 except that the small spring 424 is provided within a cavity of at least one of the right shell and the left shell and the trigger assembly 401 includes the compression chamber pusher 506 for engaging the compression chamber. Specifically, the trigger assembly 401 generally includes the trigger 434, the swing arm 428, the small spring 424, the swing arm pusher 426, the right trigger guard 502, the left trigger guard 504, and the compression chamber pusher 506. The trigger assembly 401 acts as both a trigger mechanism to allow the user to launch a dart, such as dart 300, and a cocking mechanism to cock (i.e. actuate) the compression assembly 403 from a safe position to a launch position.

Referring to FIGS. 13 and 14, the trigger 434 includes an aperture 438 formed at a lower end thereof. A shell shaft 440 extends inwardly from at least one of the right shell 402 and the left shell 432. The shell shaft 440 is received within the aperture 438 of the trigger 434 such that the trigger 434 is pivotal about a first pivot axis P1. The trigger 434 is pivotal from an undepressed position, as shown in FIG. 14, to a depressed position upon pivoting in the direction of arrow A1 about pivot axis P1. The trigger 434 is pivotal from the depressed position to the undepressed position, as shown in FIG. 14, upon pivoting in the direction of arrow A2 about pivot axis P1. The trigger 434 has a medial trigger aperture 516 for attaching the swing arm 428.

As shown in FIG. 13, the right trigger guard 502 and the left trigger guard 504 each include a lower guard aperture 518 formed at a lower end thereof. The right trigger guard 502 and the left trigger guard 504 each include a medial guard aperture 520 extending therethrough. At least one of the right trigger guard 502 and the left trigger guard 504 may include a guard shaft 522 defining the surrounding the medial guard aperture 520. A fastener 524 may be provided to extend through the medial guard apertures 520 to secure the right trigger guard 502 to the left trigger guard 504 on opposite sides of the trigger 434.

In some embodiments, the shell shaft 440 includes a central aperture 442 and in which a long fastener 420 extends through the right shell 402, the central aperture 442 of the shell shaft 440, the lower guard aperture 518 of the right trigger guard 502 and the left trigger guard 504, and the left shell 432 to secure the trigger 434, the right trigger guard 502, and the left trigger guard 504 to the right shell 402 and the left shell 432.

The swing arm 428 has a lower swing arm aperture 428A formed at a lower end thereof and an upper swing arm aperture 428B formed at an opposite upper end thereof. The swing arm 428 further includes an engagement portion 444 proximate the upper swing arm aperture 428B. The engagement portion 444 includes an engagement surface 446 and an engagement knob 448 that extends outwardly from the engagement surface 446. The swing arm 428 is secured to the trigger 434 by inserting a fastener 526 through the lower swing arm aperture 428A and the medial trigger aperture 516.

The compression chamber pusher 506 is provided within a cavity 508 formed in at least one of the right shell 402 and the left shell 432. The compression chamber pusher 506 has a forward end 510 including a guide 498 extending upwardly therefrom and a rear end 512 opposite the forward end 510. The rear end 512 of the compression chamber pusher 506 is pivotally connected to the trigger 434 by a fastener 514 extending through an upper trigger aperture 434A of the trigger 434 and a rear pusher aperture 512A of the compression chamber pusher 506. The engagement of the compression chamber pusher 506 within the cavity 508 allows the compression chamber pusher 506 to be linearly displaced in the direction of arrow A3 and A3' as the trigger 434 moves between the undepressed position and the depressed position.

Referring to FIGS. 13 and 14, the swing arm pusher 426 of the four shot toy dart gun 400 is similar to the swing arm pusher 126 of the four shot toy dart gun 100. Specifically, the swing arm pusher 426 generally includes an inclined surface 454 for deflecting the swing arm 428 and a depression surface 458C for deflecting the plunger 406, as discussed herein. In some embodiments, the swing arm pusher 426 is secured to at least one of the right shell 402 and the left shell 432 by a small screw 515.

As shown in FIG. 14, the small spring 424 has one end secured to at least one of the right shell 402 and the left shell 432 by the short fastener 422 and an opposite end secured to the trigger 434 by the short fastener 422. The small spring 424 biases the swing arm 428 toward the safe position.

In the undepressed position, as shown in FIG. 14, the trigger 434 is not actuated and the swing arm 428 is in the safe position due to the biasing force of the small spring 424. In the depressed position, the trigger 434 is rotated about pivot P1 in the direction of arrow A1 and the plunger 406 is drawn in the direction of arrow A3. Specifically, the trigger 434 is depressed by a user and the trigger 434 overcomes the biasing force of the small spring 424 attached to the swing arm 428 and the trigger 434 pivots about pivot axis P1 in the direction of arrow A1. Upon release of the trigger 434 in the depressed position, the swing arm 428 is biased toward the safe position by the biasing force of the small spring 424 and the trigger 434 pivots about pivot axis P1 in the direction of arrow A2 due to the swing arm 428 being in abutting contact with the trigger 434.

Referring to FIGS. 13 and 14, the compression assembly 403 of the four shot toy dart gun 400 is similar to the compression assembly 103 of the four shot toy dart gun 100 except that the plunger 406 is a two-piece assembly. Specifically, the compression assembly 403 generally includes the large spring 404, the plunger 406, the exterior plunger O-ring 408, the compression chamber holder 410, the compression chamber 412, the compression chamber O-ring 414, the compression chamber pin 416, and the barrel 418. The compression assembly 403 is moveable between an uncompressed (i.e. safe) position and a compressed (i.e. launch) position upon movement of the plunger 406 between a retracted position and an extended position. In the retracted position, a portion of the plunger 406 positioned within the compression chamber 412 is greater than a portion of the plunger 406 positioned within the compression chamber 412 when in the extended position.

The plunger 406 includes a plunger shaft 480 having a first end 480A and an opposite second end 480B. A hook portion 470 is fixed to the first end 480A of the plunger shaft 480 and a head portion 468 is secured to the second end 480B of the plunger shaft 480 by a fastener 480C extending through the head portion 468 and into the second end 480B of the plunger shaft 480. The exterior plunger O-ring 408 is received within an exterior plunger O-ring groove 472 formed on an exterior surface of the head portion 468 and an interior plunger O-ring 480D is received within an interior plunger O-ring groove 480E formed within head portion 468 surrounding the fastener 480C when inserted through the head portion 468. The exterior plunger O-ring 408 and the interior plunger O-ring 480D provide an airtight seal with an interior surface of the compression chamber 412.

As with the plunger 106 of the four shot toy dart gun 100, the hook portion 470 of the plunger 406 includes a recess 474, a tapered surface 476, and a plunger ledge 478. The plunger 406 is provided within a track 484 formed on at least one of the right shell 402 and the left shell 432 to guide the plunger 406 to be linearly displaced in the direction of arrows A4 and A4'.

Upon depression of the trigger 434 by a user, the plunger 406 is drawn in the direction of arrow A4 and contacts the depression surface 458C of the swing arm pusher 426, which deflects the hook portion 470 of the plunger 406 downward in the direction of arrow C1. The deflection of the hook portion 470 downwardly in the direction of arrow C1 facilitates the disengagement of the engagement knob 448 of the swing arm 428 and the recess 474 of the plunger 406. In some embodiments, the swing arm pusher 426 includes a second inclined surface 458D extending adjacent the depression surface 458C for pushing the plunger 406 in a direction opposite the deflection of the swing arm 428 and further disengaging the plunger 406 from the swing arm 428. Further, as the swing arm 428 draws the plunger 406 in the direction of arrow A4, the engagement knob 448 slides along the inclined surface 454 of the swing arm pusher 426, which pushes the swing arm 428 out of engagement with the recess 474 of the plunger 406. Upon disengagement of the engagement knob 448 from the recess 474, the plunger 406 moves in the direction of arrow A4' and the plunger 406 slides upwardly in the direction of arrow C1'.

Referring to FIGS. 15-22, an embodiment of a five shot toy dart gun is generally illustrated at 600. The five shot toy dart gun 600 is a double click type toy dart gun in which a first action by a user partially cocks a compression assembly and a second action by the user further cocks and actuates the compression assembly to launch a dart. The partial cocking of the five shot toy dart gun 600 allows for compression assembly to be cocked by two separate gripping actions of a trigger in which each gripping action has a reduced degree of motion than the single gripping action required by the four shot toy dart guns 100, 400 discussed herein. The two separate gripping actions makes it easier for those having weaker gripping abilities to cock and actuate the compression assembly. It should be appreciated that the five shot toy dart gun 600 may be modified to shoot any number of darts.

The five shot toy dart gun 600 includes a right shell 602, a large spring 604, a plunger 606, an exterior plunger O-ring 608, a compression chamber holder 610, a compression chamber 612, a compression chamber O-ring 614, a compression chamber pin 616, a barrel 618, long fasteners (e.g. screws) 620, short fasteners (e.g. screws) 622, a small spring 624, a swing arm pusher 426, a swing arm 628, a left shell 632, a trigger 634, a swing arm pusher spring 702, a plunger pusher 704, and a compression chamber pusher 706. The right shell 602 and the left shell 632 are joined to form a two-piece gun shell.

The five shot toy dart gun 600 also includes a trigger assembly 601 and a compression assembly 603. The trigger assembly 601 is similar to the trigger assembly 401 of the four shot toy dart gun 400 except that the swing arm pusher 626 is slidably movable to lock the plunger 606 in a partially extended position. Specifically, the trigger assembly 601 generally includes the trigger 634, the swing arm 628, the small spring 624, the swing arm pusher 626, the swing arm pusher spring 702, the plunger pusher 704, and the compression chamber pusher 706. The trigger assembly 601 acts as both a trigger mechanism to allow the user to launch a dart, such as dart 300, and a cocking mechanism to cock (i.e. actuate) the compression assembly 603 from a safe position to a launch position.

Figure 16:
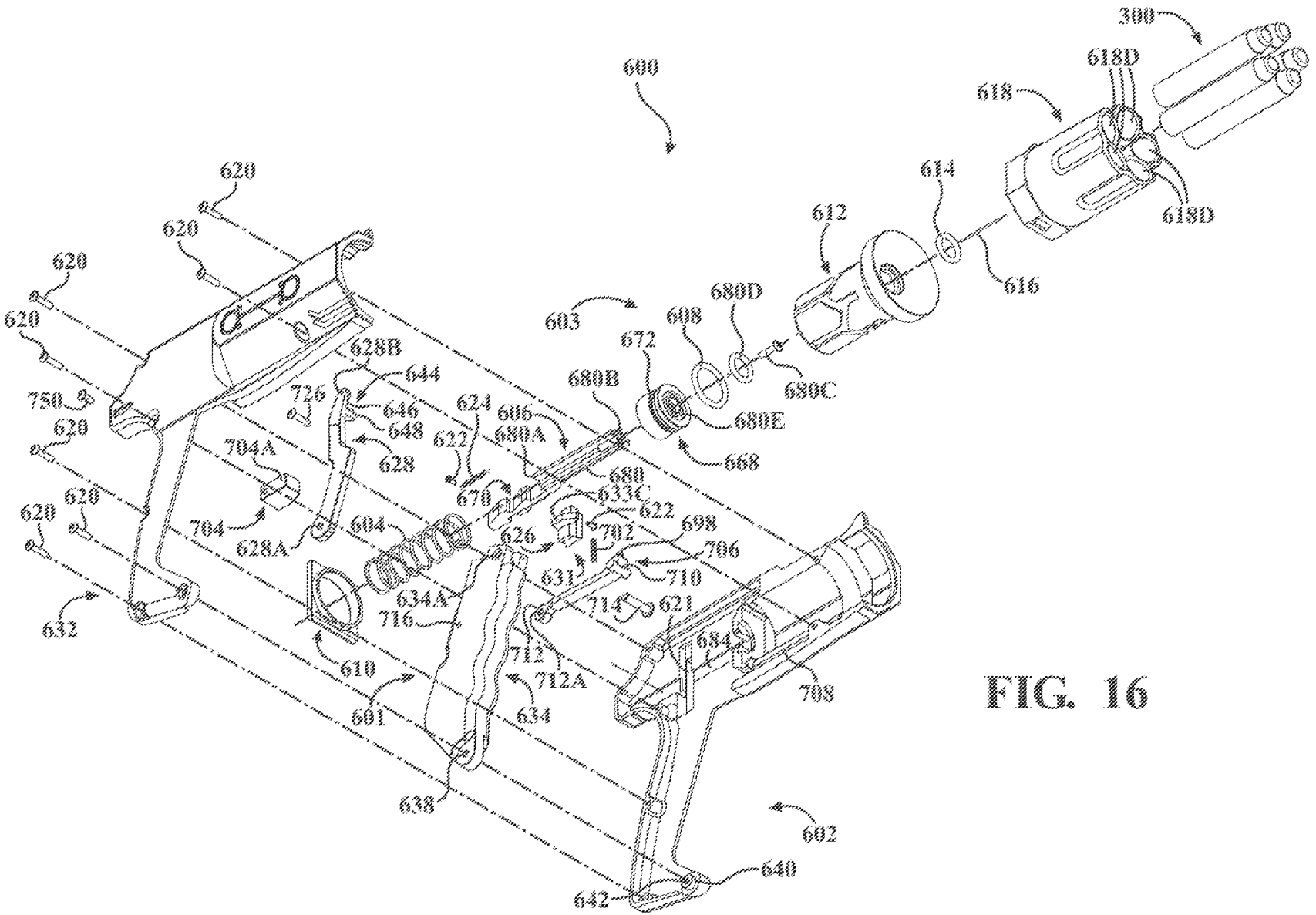
FIG. 16 schematically depicts an exploded view of the five shooter toy dart gun of FIG. 15, according to one or more embodiments shown or described herein.
Figure 18:
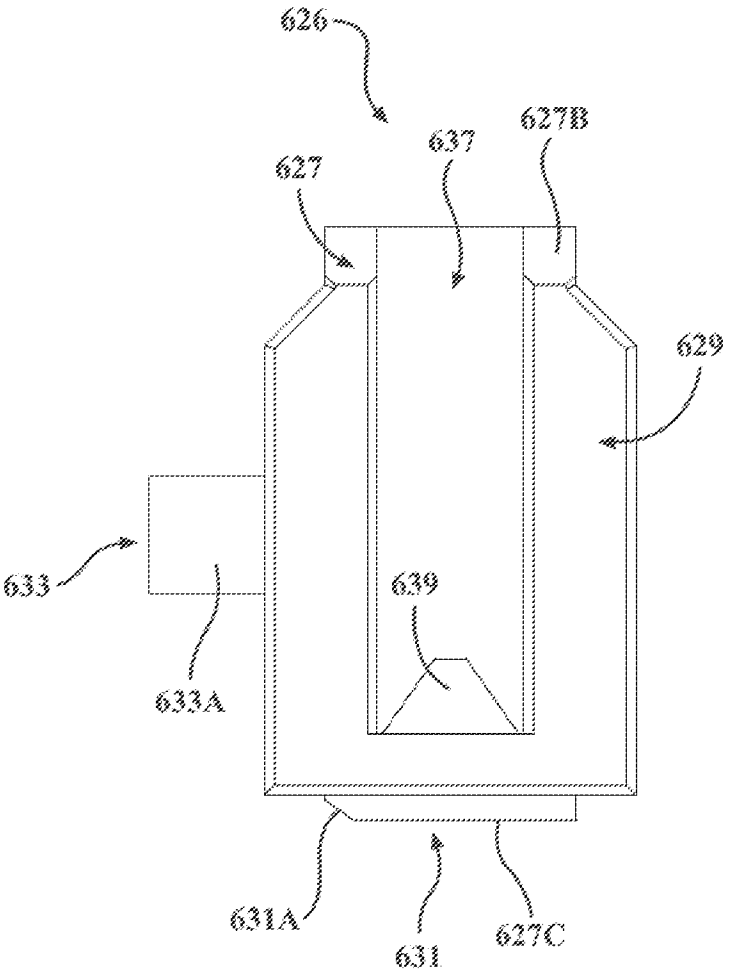
FIG. 18 schematically depicts an opposite side view of the swing arm pusher of the five shooter toy dart gun of FIG. 15, according to one or more embodiments shown or described herein.
Figure 17:
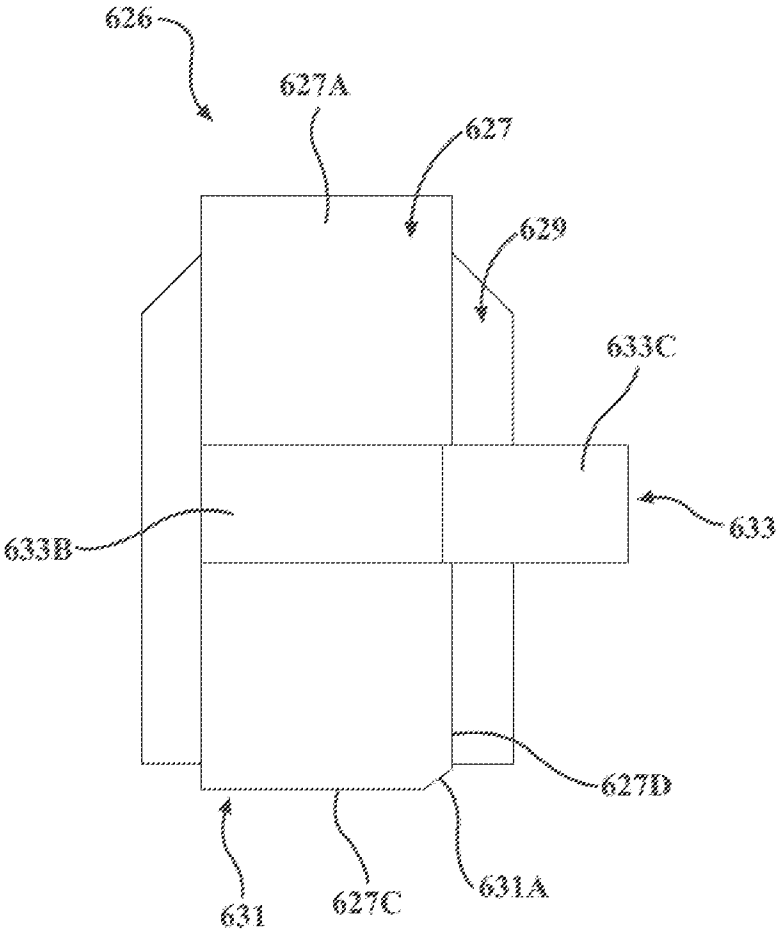
FIG. 17 schematically depicts a side view of a swing arm pusher of the five shooter toy dart gun of FIG. 15, according to one or more embodiments shown or described herein.
Figure 19:
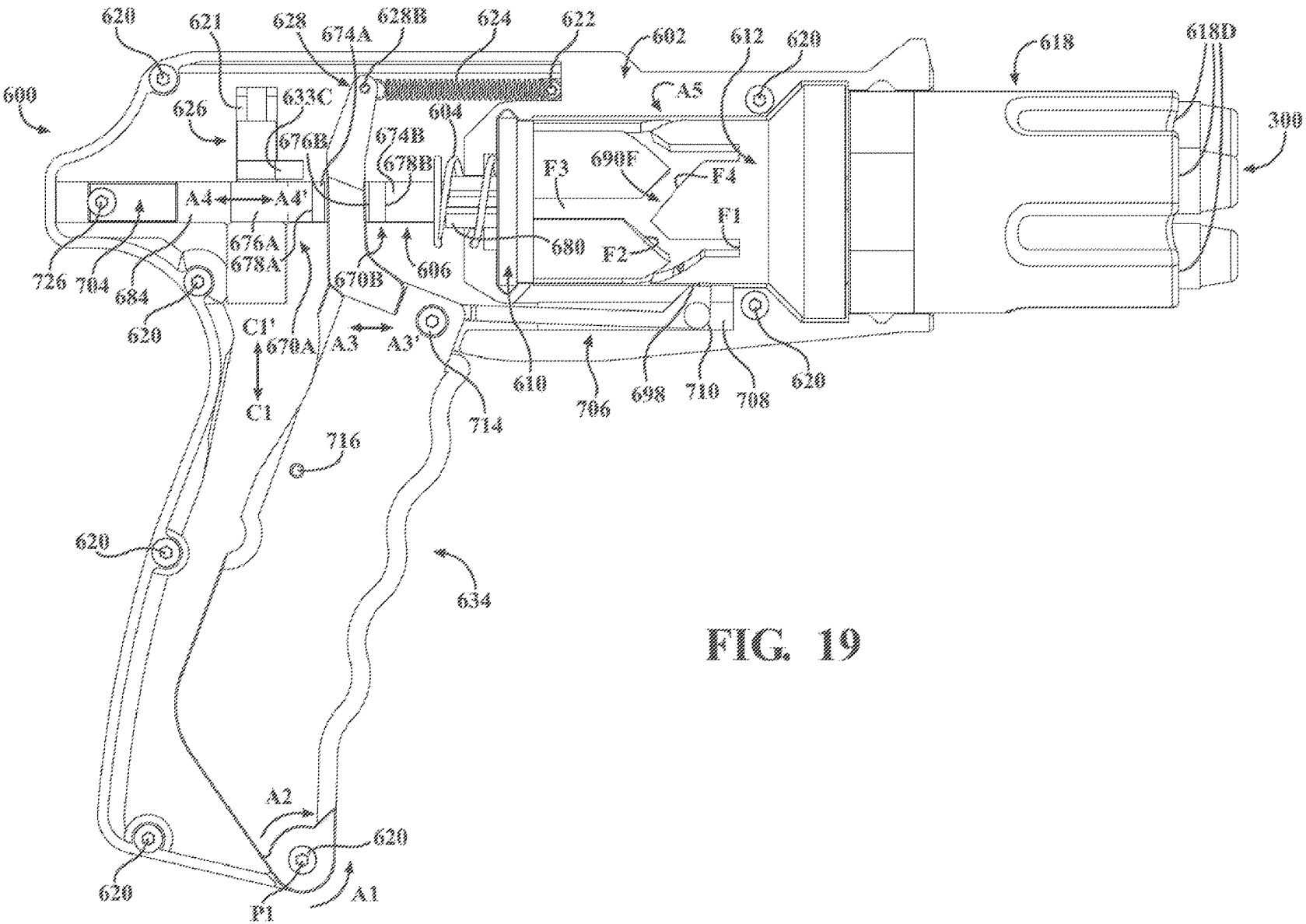
FIG. 19 schematically depicts a partial side view of the five shooter toy dart gun of FIG. 15 in an undepressed position and a retracted position, according to one or more embodiments shown or described herein.
Figure 21:
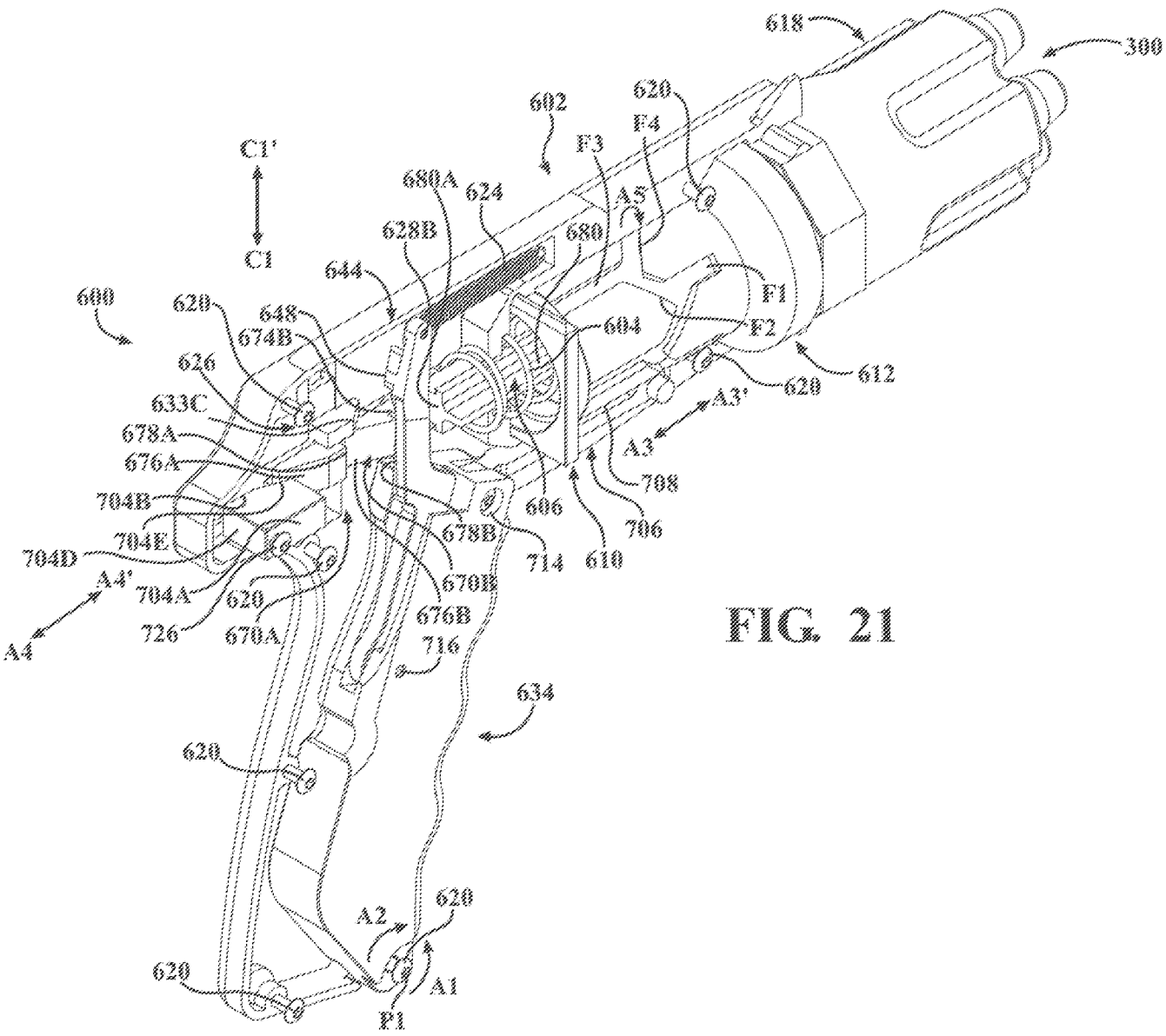
FIG. 21 schematically depicts a partial perspective view of the five shooter toy dart gun of FIG. 15 in the undepressed position and a partially extended position, according to one or more embodiments shown or described herein.

Referring to FIGS. 16, 19, and 21, the trigger 634 includes an aperture 638 formed at a lower end thereof. A shell shaft 640 extends inwardly from at least one of the right shell 602 and the left shell 632. The shell shaft 640 is received within the aperture 638 of the trigger 634 such that the trigger 634 is pivotal about a first pivot axis P1. The trigger 634 is pivotal from an undepressed position, as shown in FIG. 19, to a depressed position upon pivoting in the direction of arrow A1 about pivot axis P1. The trigger 634 is pivotal from the depressed position to the undepressed position, as shown in FIG. 14, upon pivoting in the direction of arrow A2 about pivot axis P1. The trigger 634 has a medial trigger aperture 716 for attaching the swing arm 628.

In some embodiments, the shell shaft 640 includes a central aperture 642 and in which a long fastener 620 extends through the right shell 602, the central aperture 642 of the shell shaft 640, and the left shell 632 to secure the trigger 634 to the right shell 602 and the left shell 632.

The swing arm 628 has a lower swing arm aperture 628A formed at a lower end thereof and an upper swing arm aperture 628B formed at an opposite upper end thereof. The swing arm 628 further includes an engagement portion 644 proximate the upper swing arm aperture 628B. The engagement portion 644 includes an engagement surface 646 and an engagement knob 648 that extends outwardly from the engagement surface 646. The swing arm 628 is secured to the trigger 634 by inserting a fastener 726 through the lower swing arm aperture 628A and the medial trigger aperture 716.

The compression chamber pusher 706 is provided within a cavity 708 formed in at least one of the right shell 602 and the left shell 632. The compression chamber pusher 706 has a forward end 710 including a guide 698 extending upwardly therefrom and a rear end 712 opposite the forward end 710. The rear end 712 of the compression chamber pusher 706 is pivotally connected to the trigger 634 by a fastener 714 extending through an upper trigger aperture 634A of the trigger 634 and a rear pusher aperture 712A of the compression chamber pusher 706. The engagement of the compression chamber pusher 706 within the cavity 708 allows the compression chamber pusher 706 to be linearly displaced in the direction of arrow A3 and A3' as the trigger 634 moves between the undepressed position and the depressed position.

Referring to FIGS. 16-22, the swing arm pusher 626 is slidably movable to lock the plunger 606 in a partially extended position. Specifically, the swing arm pusher 626 includes an engagement portion 627 having an engagement side surface 627A and an opposite shell side surface 627B. The engagement portion 627 includes a locking member 631 provided at a lower end 627C of the engagement portion 627 and the locking member 631 has a first inclined surface 631A proximate a forward end 627D of the engagement portion. A projection 633 is provided on the engagement side surface 627A including a rear surface 633A, a discharge surface 633B, and a second inclined surface 633C extending between the rear surface 633A and the discharge surface 633B. Engagement of the swing arm 628 with the second inclined surface 633C deflects the swing arm 628 away from the plunger 606, as discussed herein.

Figure 20:
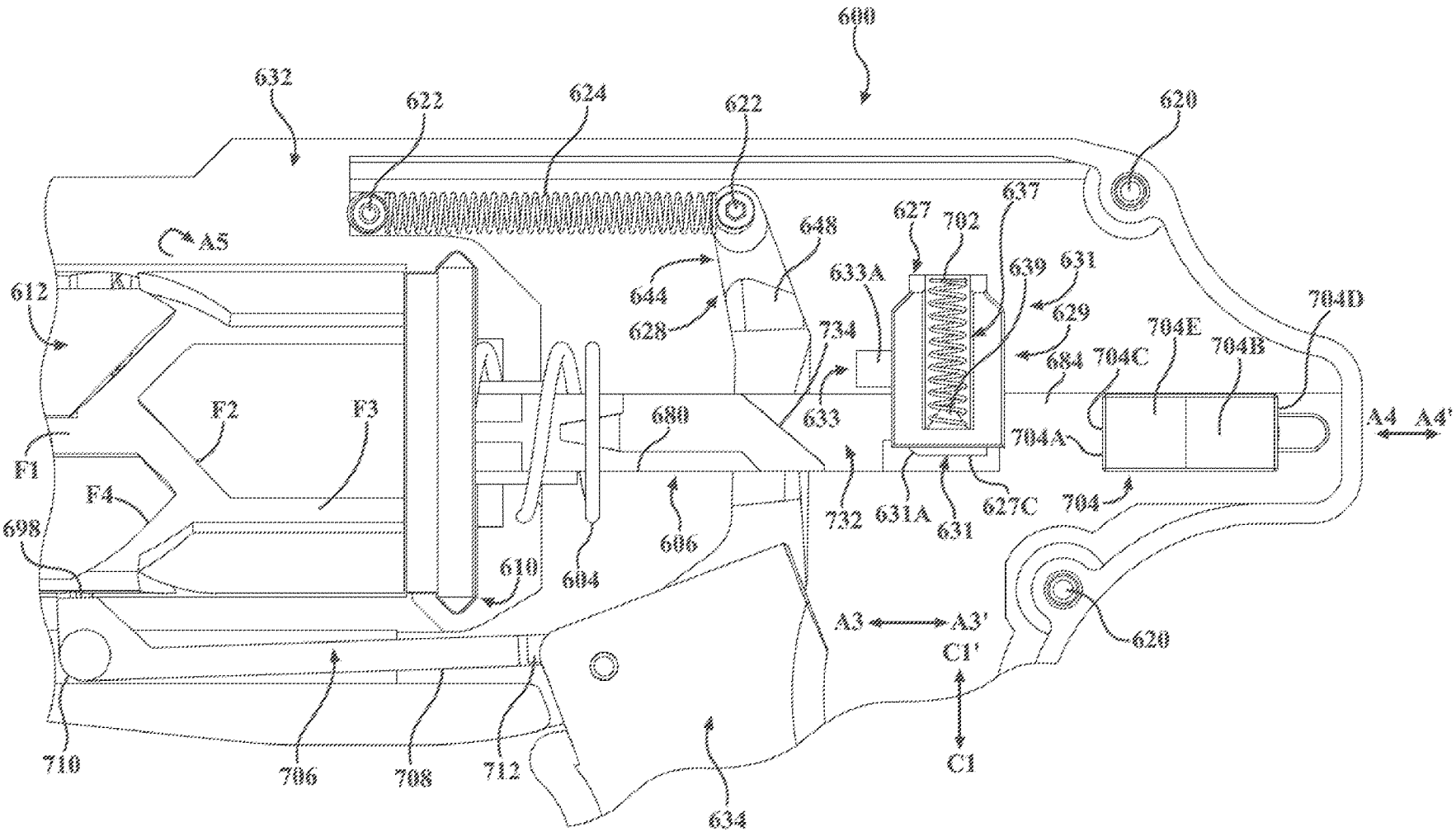
FIG. 20 schematically depicts a partial opposite side view of the five shooter toy dart gun of FIG. 15 in the undepressed position and the retracted position, according to one or more embodiments shown or described herein.
Figure 22:
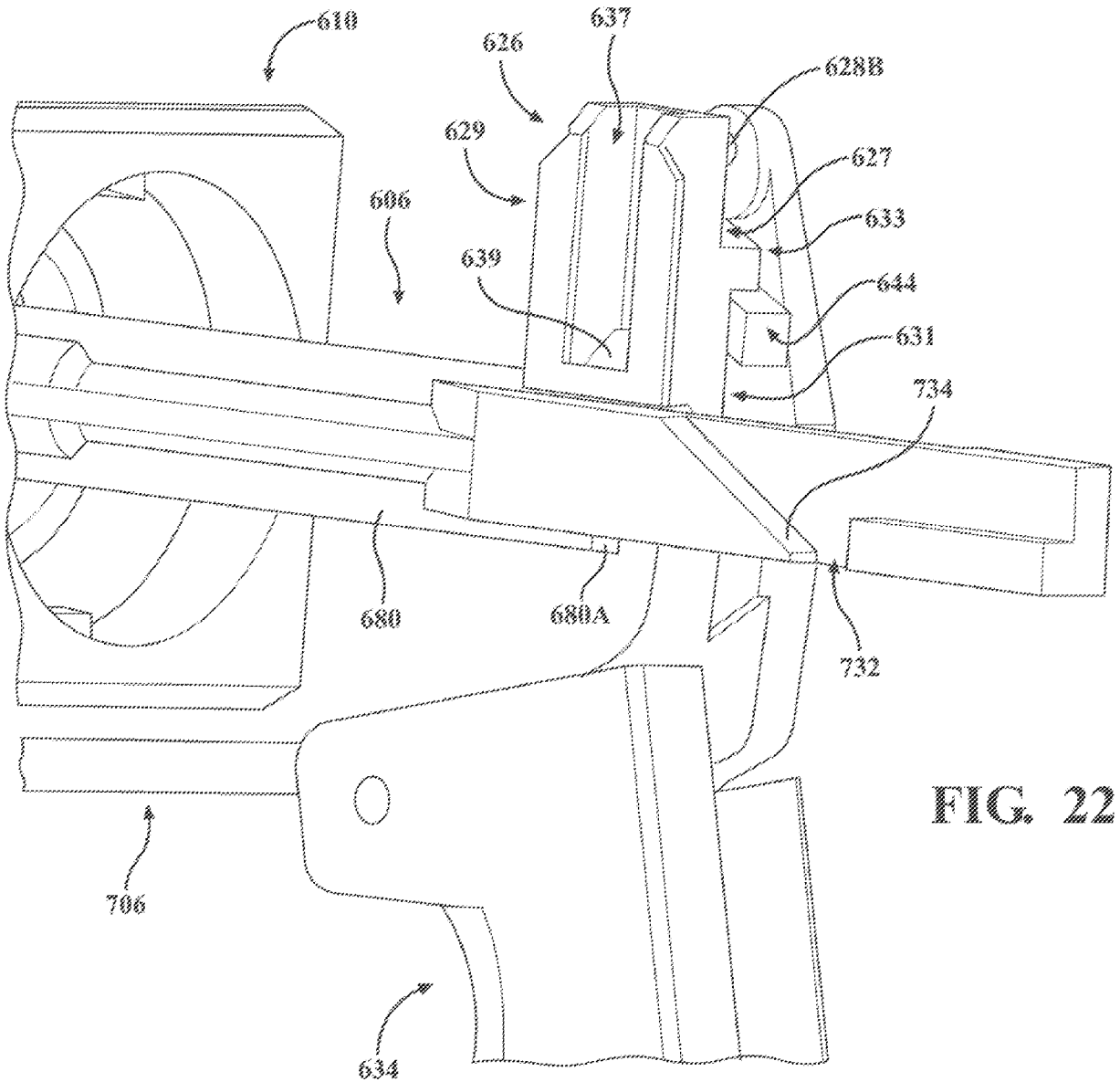
FIG. 22 schematically depicts a partial perspective view of the five shooter toy dart gun of FIG. 15 in a depressed position and a fully extended position, according to one or more embodiments shown or described herein.

The swing arm pusher 626 also includes a rail portion 629 provided on the shell side surface 627B of the engagement portion 627. The rail portion 629 includes a cavity 637 for housing the swing arm pusher spring 702 positioned over a lower conical member 639 for securing an end of the swing arm pusher spring 702 within the cavity 637. The swing arm pusher spring 702 biases the swing arm pusher 626 against an opposite surface of at least one of the right shell 602 and the left shell 632 to position the swing arm pusher 626 between a locked position, as shown in FIG. 20, and a free position, as shown in FIG. 22. The rail portion 629 is dimensioned to fit within a track 621 formed in at least one of the right shell 602 and the left shell 632 such that the swing arm pusher 426 is movable downward in the direction of arrow C1 and upward in the direction of arrow C1'

As shown in FIGS. 19 and 21, the small spring 624 has one end secured to at least one of the right shell 602 and the left shell 632 by the short fastener 622 and an opposite end secured to the trigger 634 by the short fastener 622. The small spring 624 biases the swing arm 628 toward the safe position.

In the undepressed position, as shown in FIGS. 19-21, the trigger 634 is not actuated and the swing arm 628 is in the safe position due to the biasing force of the small spring 624. In the depressed position, as shown in FIG. 22, the trigger 634 is rotated about pivot P1 in the direction of arrow A1 and the plunger 606 is drawn in the direction of arrow A3. Specifically, the trigger 634 is depressed by a user and the trigger 634 overcomes the biasing force of the small spring 624 attached to the swing arm 628 and the trigger 634 pivots about pivot axis P1 in the direction of arrow A1. Upon release of the trigger 634 in the depressed position, the swing arm 628 is biased toward the safe position by the biasing force of the small spring 624 and the trigger 634 pivots about pivot axis P1 in the direction of arrow A2 due to the swing arm 628 being in abutting contact with the trigger 634.

Referring to FIGS. 16-22, the compression assembly 603 of the five shot toy dart gun 600 is similar to the compression assembly 403 of the four shot toy dart gun 400 except that the plunger 606 has a pair of recesses 674A, 674B and a pair of tapered surfaces 676A, 676B. Specifically, the compression assembly 603 generally includes the large spring 604, the plunger 606, the exterior plunger O-ring 608, the compression chamber holder 610, the compression chamber 612, the compression chamber O-ring 614, the compression chamber pin 616, and the barrel 618. The compression assembly 603 is moveable between an uncompressed (i.e. safe) position and a compressed (i.e. launch) position upon movement of the plunger 606 between a retracted position and an extended position. In the retracted position, a portion of the plunger 606 positioned within the compression chamber 612 is greater than a portion of the plunger 606 positioned within the compression chamber 612 when in the extended position.

Referring to FIGS. 16 and 19-22, the plunger 606 includes a plunger shaft 680 having a first end 680A and an opposite second end 680B. A hook portion 670 is fixed to the first end 680A of the plunger shaft 680 and a head portion 668 is secured to the second end 680B of the plunger shaft 680 by a fastener 680C extending through the head portion 668 and into the second end 680B of the plunger shaft 680. The exterior plunger O-ring 608 is received within an exterior plunger O-ring groove 672 formed on an exterior surface of the head portion 668 and an interior plunger O-ring 680D is received within an interior plunger O-ring groove 680E formed within head portion 668 surrounding the fastener 680C when inserted through the head portion 668. The exterior plunger O-ring 608 and the interior plunger O-ring 680D provide an airtight seal with an interior surface of the compression chamber 612. The plunger 606 is provided within a track 684 formed on at least one of the right shell 602 and the left shell 632 to guide the plunger 606 to be linearly displaced in the direction of arrows A4 and A4'.

The hook portion 670 of the plunger 606 includes a first hook 670A and a second hook 670B. The first hook 670A includes a first recess 674A, a first tapered surface 676A, and a first plunger ledge 678A. The second hook 670B includes a second recess 674B, a second tapered surface 676B, and a second plunger ledge 678B. On an opposite shell facing surface 730 of the plunger 606, the plunger 606 includes a notch 732 for receiving the locking member 631 of the swing arm pusher 626 when the swing arm pusher 626 is biased downward in the direction of arrow C1 and into the locked position, and a rear plunger inclined surface 734 for pushing the swing arm pusher 626 upward in the direction of arrow C1' and into the free position.

Referring to FIGS. 16 and 19-21, the plunger pusher 704 is secured to at least one of the right shell 602 or the left shell 632 opposite the swing arm pusher 626. The plunger pusher 704 may be secured by a fastener 750. The plunger pusher 704 includes a shell facing surface 704A, a plunger facing surface 704B, a forward surface 704C, and a rear surface 704D. The plunger facing surface 704B has a tapered portion 704E located proximate the forward surface 704C for pushing the plunger 606 out of engagement with the swing arm 628.

As shown in FIGS. 16 and 19, the compression chamber 612 is similar to the compression chamber 112 of the four shot toy dart gun 100 except that the compression chamber 612 includes a pathway 690F having five safe recesses F1, five fire inclined surfaces F2, five fire paths F3, and five return inclined surfaces F4 to accommodate five dart openings 618D of the barrel 618. Therefore, each firing of the five shot toy dart gun 600 rotates the compression chamber 612 72°. However, it is to be understood that the compression chamber 612 is not limited to being configured to fire five darts as described herein.

Initially, when the trigger 634 is in the undepressed position and the plunger 606 is in the retracted position, as shown in FIG. 19, the engagement knob 648 of the swing arm 628 is positioned within the first recess 674A of the first hook 670A of the plunger 606. Upon a first depression of the trigger 634 by a user, the plunger 606 is drawn in the direction of arrow A4 and the swing arm pusher 626 engages the notch 732 to lock the plunger 606 in the partially extended position. The swing arm pusher 626 locks the plunger 606 in the partially extended position, as shown in FIGS. 20-22, and allows the trigger 634 to be released and returned back to the undepressed position without permitting the plunger 606 to return to the retracted position. As the trigger 634 returns to the undepressed position, the swing arm 628 slides across the first tapered surface 676A of the first hook 670A of the plunger 606, moves out of the first recess 674A, and engages the second recess 674B of the second hook 670B of the plunger 606, as shown in FIG. 21. Upon a second depression of the trigger 634 by the user, the plunger 606 is drawn further in the direction of arrow A4 toward the fully extended position and the swing arm pusher 626 is moved upward in the direction of arrow C1' as the swing arm pusher 626 slides across the rear plunger inclined surface 734, as shown in FIG. 22.

Continued depression of the trigger 634 causes the engagement knob 648 of the swing arm 628 to slide across the second inclined surface 633C and push the swing arm 628 to disengage the second recess 674B of the plunger 606. Simultaneously, when the plunger 606 reaches the fully extended position, the first tapered surface 676A of the first hook 670A of the plunger 606 engages the tapered portion 704E of the plunger pusher 704, which pushes the plunger 606 away from the swing arm 628 to further disengage the swing arm 628 from the plunger 606. Upon disengagement of the engagement knob 648 from the second recess 674B, the plunger 606 moves in the direction of arrow A4' and returns to the retracted position within the compression chamber 612 to fire the dart.

From the above, it is to be appreciated that defined herein is a toy dart gun having double action trigger assemblies in which a single action by a user both cocks and actuates a compression assembly to launch a dart.

While particular embodiments and aspects of the present disclosure have been illustrated and described herein, various other changes and modifications can be made without departing from the spirit and scope of the disclosure. Moreover, although various aspects have been described herein, such aspects need not be utilized in combination. It is therefore intended that the appended claims cover all such changes and modifications that are within the scope of the embodiments shown and described herein.

What is claimed is:

1. A toy dart gun comprising:

a gun shell;

a trigger assembly comprising a swing arm coupled to the gun shell and movable between a safe position and a fire position; and a compression assembly comprising:

a compression chamber; and a plunger slidably insertable through the compression chamber and movable between a retracted position and an extended position, wherein as the swing arm moves toward the fire position, the swing arm engages the plunger and pulls the plunger toward the extended position, wherein when the swing arm is in the fire position, the swing arm disengages the plunger and the plunger is biased toward the retracted position.

2. The toy dart gun of claim 1, wherein:

the trigger assembly further comprises a swing arm pusher having an inclined surface;

the compression chamber is positioned within the gun shell and has a barrel opening and an opposite holder opening;

the plunger is slidably insertable through the holder opening of the compression chamber; and when the swing arm is in the fire position, the swing arm pusher deflects the swing arm from engagement with the plunger and the plunger is biased toward the retracted position.

3. The toy dart gun of claim 2, wherein the trigger assembly further comprises a trigger movable between an undepressed position and a depressed position, the trigger causing the swing arm to pivot toward the fire position as the trigger moves toward the depressed position, wherein the swing arm is pivotally attached to the gun shell.

4. The toy dart gun of claim 2, wherein when the plunger is in the retracted position, a portion of the plunger positioned within the compression chamber is greater than a portion of the plunger positioned within the compression chamber when in the extended position.

5. The toy dart gun of claim 2, further comprising:

a large spring abutting against the plunger for biasing the plunger toward the retracted position; and a small spring coupled to the swing arm for biasing the swing arm toward the safe position.

6. The toy dart gun of claim 2, wherein the plunger includes a recess and the swing arm includes an engagement knob for engaging the recess and moving the plunger toward the extended position as the swing arm moves toward the fire position.

7. The toy dart gun of claim 2, wherein the compression chamber includes an outer surface and a pathway recessed into the outer surface, the pathway including a plurality of safe recesses, a plurality of fire inclined surfaces, a plurality of fire paths, and a plurality of return inclined surfaces, each fire inclined surface extending between an adjacent safe recess and an adjacent fire path, each return inclined surface extending between an adjacent safe recess and an adjacent fire path.

8. The toy dart gun of claim 7, further comprising:

a guide coupled to the swing arm, the guide engaging the pathway of the compression chamber, wherein when the swing arm moves toward the fire position, the guide moves out of one of the plurality of safe recesses, along an adjacent fire inclined surface, and into an adjacent fire path, wherein when the swing arm moves toward the safe position, the guide moves out of one of the plurality of fire paths, along an adjacent return inclined surface, and into an adjacent safe recess.

9. The toy dart gun of claim 8, wherein movement of the guide along the pathway rotates the compression chamber.

10. The toy dart gun of claim 9, further comprising a barrel positioned adjacent the barrel opening of the compression chamber, the barrel housing at least one dart.

11. The toy dart gun of claim 10, wherein the barrel includes a plurality of dart openings, each dart opening configured to house a dart, a dart opening of the plurality of dart openings aligning with the barrel opening as the compression chamber rotates.

12. The toy dart gun of claim 7, wherein the plurality of fire paths are equidistantly spaced apart from one another along the outer surface of the compression chamber.

13. The toy dart gun of claim 12, wherein the compression chamber includes four fire paths and four barrel openings.

14. A toy dart gun comprising:

a gun shell;

a trigger assembly comprising:

a swing arm movable between a safe position and a fire position; and a trigger pivotally attached to the gun shell and coupled to the swing arm, the trigger movable between an undepressed position and a depressed position, the trigger causing the swing arm to move toward the fire position as the trigger pivots toward the depressed position;

a compression assembly comprising:

a compression chamber; and a plunger slidably insertable through the compression chamber and movable between a retracted position and an extended position, wherein as the swing arm moves toward the fire position, the swing arm engages the plunger and pulls the plunger toward the extended position, wherein when the swing arm is in the fire position, the swing arm disengages the plunger and the plunger is biased toward the retracted position.

15. The toy dart gun of claim 14, wherein:

the trigger assembly further comprises a swing arm pusher having an inclined surface;

the compression chamber positioned within the gun shell and has a barrel opening and an opposite holder opening;

the plunger is slidably insertable through the holder opening of the compression chamber; and the swing arm pusher deflects the swing arm from engagement with the plunger and the plunger is biased toward the retracted position.

16. The toy dart gun of claim 15, wherein when the plunger is in the retracted position, a portion of the plunger positioned within the compression chamber is greater than a portion of the plunger positioned within the compression chamber when in the extended position.

17. The toy dart gun of claim 15, further comprising:

a large spring abutting against the plunger for biasing the plunger toward the retracted position; and a small spring coupled to the swing arm for biasing the swing arm toward the safe position.

18. The toy dart gun of claim 15, further comprising:

a guide coupled to the swing arm;

the compression chamber further comprising an outer surface and a pathway recessed into the outer surface, the pathway including a plurality of safe recesses, a plurality of fire inclined surfaces, a plurality of fire paths, and a plurality of return inclined surfaces, each fire inclined surface extending between an adjacent safe recess and an adjacent fire path, each return inclined surface extending between an adjacent safe recess and an adjacent fire path, wherein the guide engages the pathway of the compression chamber, wherein when the swing arm moves toward the fire position, the guide moves out of one of the plurality of safe recesses, along an adjacent fire inclined surface, and into an adjacent fire path, wherein when the swing arm moves toward the safe position, the guide moves out of one of the plurality of fire paths, along an adjacent return inclined surface, and into an adjacent safe recess, wherein movement of the guide along the pathway rotates the compression chamber.

19. The toy dart gun of claim 15, wherein the swing arm pusher is movable to engage the plunger and lock the plunger in a partially extended position between the retracted position and the extended position.

20. The toy dart gun of claim 19, wherein the swing arm pusher includes a swing arm pusher spring for biasing the swing arm pusher between a free position in which the plunger is not locked in the partially extended position, and a locked position in which the plunger is locked in the partially extended position.

* * * * *